US008915391B2

(12) United States Patent
Radow

(10) Patent No.: US 8,915,391 B2
(45) Date of Patent: Dec. 23, 2014

(54) DRINKWARE RIMMING APPARATUS AND METHOD

(75) Inventor: Marc Radow, Reno, NV (US)

(73) Assignee: Roxi Group, Inc., Reno, NV (US)

( * ) Notice: Subject to any disclaimer, the term of this patent is extended or adjusted under 35 U.S.C. 154(b) by 173 days.

(21) Appl. No.: 13/368,119

(22) Filed: Feb. 7, 2012

(65) Prior Publication Data

US 2012/0219685 A1 Aug. 30, 2012

Related U.S. Application Data

(60) Provisional application No. 61/440,346, filed on Feb. 7, 2011.

(51) Int. Cl.

| | |
|---|---|
| ***A47G 19/00*** | (2006.01) |
| ***A47G 19/34*** | (2006.01) |
| ***A47G 19/30*** | (2006.01) |
| ***B65D 85/72*** | (2006.01) |
| ***A47G 19/22*** | (2006.01) |
| *A47F 5/04* | (2006.01) |

(52) U.S. Cl.

CPC ..... *A47G 19/00* (2013.01); *A47G 19/22* (2013.01); *B65F 85/73* (2013.01); *A47F 5/04* (2013.01)

USPC ..... 220/23.83; 220/23.86; 220/83.87; 426/420; 426/132; 426/590; 426/592; 427/430.1; 118/13; 211/144; 211/126.1; 211/126.2; 211/163; 211/77; 211/78; 211/129.1; 108/139; 222/144

(58) Field of Classification Search

USPC ..... 220/23.8, 23.86, 4.27, 23.83; 426/420, 426/132, 590, 592; 211/144, 126.2, 163, 211/77, 78, 131.1, 53, 56, 129.1; 118/13; 206/373; 427/430.1; 108/105, 111, 108/144, 139, 103, 193, 147.11

See application file for complete search history.

(56) References Cited

U.S. PATENT DOCUMENTS

| | | | | | |
|---|---|---|---|---|---|
| 951,664 | A | * | 3/1910 | Swan | 211/56 |
| 1,029,709 | A | * | 6/1912 | Norrlander | 312/249.4 |
| 1,896,976 | A | * | 2/1933 | Schifferdecker | 220/253 |
| D160,688 | S | * | 10/1950 | Brock | D7/501 |
| 2,951,593 | A | * | 9/1960 | Lake | 108/139 |
| 3,188,157 | A | * | 6/1965 | Rand | 312/202 |
| 3,209,796 | A | * | 10/1965 | Silletti | 141/311 R |

(Continued)

OTHER PUBLICATIONS

RoxiSpice Rimming Tower, [Internet] http://roxispice.com/details.asp/id=72, printed Apr. 17, 2012, 1 page.

*Primary Examiner* — Mickey Yu
*Assistant Examiner* — Gideon Weinerth
(74) *Attorney, Agent, or Firm* — Leech Tishman Fuscaldo & Lampl; Kenneth D'Alessandro

(57) ABSTRACT

A drinkware rimming apparatus including a wetting receptacle, a cutout, and a rotatable tray having a plurality of spice receptacles. The tray is rotatable relative to the cutout (or vice-versa) to align and provide downward access to a desired spice receptacle or to the wetting receptacle. A cover may be included and the cutout can be in the cover and/or the tray. The cover can have beverage garnish compartments on a top surface thereof. The wetting receptacle can be positioned in a tray or on the cover. The cutout can be in another tray also having one or more spice receptacles and above the first-mentioned tray and rotatable independently of the lower tray. A method of applying spice to rims of drinkware is also disclosed.

27 Claims, 15 Drawing Sheets

(56) References Cited

U.S. PATENT DOCUMENTS

| | | | | | |
|---|---|---|---|---|---|
| 3,397,805 | A | * | 8/1968 | Berend | 220/23.86 |
| 3,398,827 | A | * | 8/1968 | Laskin | 206/499 |
| 3,413,128 | A | * | 11/1968 | Steinbarth et al. | 426/115 |
| 3,450,096 | A | | 6/1969 | Lancette | |
| 3,498,471 | A | * | 3/1970 | Dirkx | 211/131.1 |
| 3,561,592 | A | * | 2/1971 | McCool | 206/534 |
| 3,947,991 | A | * | 4/1976 | Morcom | 43/54.1 |
| 3,951,079 | A | * | 4/1976 | Tolleson | 108/94 |
| 4,438,853 | A | * | 3/1984 | Numbers | 211/77 |
| 4,505,386 | A | * | 3/1985 | Abrahamson | 206/315.11 |
| 4,632,474 | A | * | 12/1986 | Ingersoll | 312/305 |
| D291,181 | S | * | 8/1987 | Franco | D9/428 |
| 4,688,684 | A | * | 8/1987 | Young et al. | 211/59.4 |
| 4,700,850 | A | * | 10/1987 | Morgan et al. | 211/131.1 |
| 4,775,055 | A | * | 10/1988 | Morse | 211/78 |
| D317,838 | S | * | 7/1991 | Millet et al. | D6/472 |
| D323,446 | S | * | 1/1992 | Morse | D7/600.2 |
| D325,281 | S | * | 4/1992 | Jordan | D3/302 |
| 5,279,429 | A | * | 1/1994 | Sagel | 211/131.1 |
| 5,337,892 | A | * | 8/1994 | Zaffina | 206/315.11 |
| 5,540,329 | A | * | 7/1996 | Vogeley | 206/373 |
| 5,547,098 | A | * | 8/1996 | Jordan | 220/23.86 |
| 5,641,080 | A | * | 6/1997 | Humphrey et al. | 211/77 |
| 5,799,787 | A | * | 9/1998 | Talbot | 206/315.11 |
| D401,810 | S | * | 12/1998 | Swift | D7/553.6 |
| D407,920 | S | * | 4/1999 | Duffield | D6/461 |
| 5,894,944 | A | * | 4/1999 | Swift | 211/78 |
| 6,016,927 | A | * | 1/2000 | Krupp | 211/126.2 |
| 6,265,010 | B1 | * | 7/2001 | Franco | 426/420 |
| 6,439,406 | B1 | * | 8/2002 | Duhon | 211/131.1 |
| 6,505,747 | B1 | * | 1/2003 | Robertson | 211/74 |
| 6,631,804 | B2 | * | 10/2003 | Wong | 206/526 |
| D505,833 | S | * | 6/2005 | Ahearn | D7/553.4 |
| D515,874 | S | * | 2/2006 | Aalberts | D7/590 |
| 7,156,226 | B1 | * | 1/2007 | Van Sickle | 206/216 |
| 7,225,633 | B2 | * | 6/2007 | DeMars | 62/457.6 |
| D589,652 | S | * | 3/2009 | Nip | D28/73 |
| 7,584,973 | B2 | * | 9/2009 | Brager | 280/47.35 |
| 7,748,537 | B1 | * | 7/2010 | Manger | 206/557 |
| 7,882,796 | B2 | | 2/2011 | Radow | |
| 7,942,283 | B2 | * | 5/2011 | Radow | 220/23.86 |
| D664,803 | S | * | 8/2012 | Argondizzo et al. | D7/368 |
| 8,292,096 | B2 | * | 10/2012 | Thompson | 211/77 |
| D679,056 | S | * | 3/2013 | Mazza | D28/73 |
| 8,528,873 | B2 | * | 9/2013 | Domenig et al. | 248/239 |
| 8,544,390 | B1 | * | 10/2013 | Bahnsen | 108/94 |
| 2002/0170868 | A1 | * | 11/2002 | Morgan | 211/77 |
| 2003/0000903 | A1 | * | 1/2003 | Mondragon et al. | 211/144 |
| 2003/0015446 | A1 | * | 1/2003 | Talbot | 206/373 |
| 2003/0029768 | A1 | * | 2/2003 | Wong | 206/526 |
| 2003/0038097 | A1 | * | 2/2003 | Palder | 211/49.1 |
| 2003/0192840 | A1 | * | 10/2003 | Hoyle et al. | 211/85.2 |
| 2004/0206302 | A1 | * | 10/2004 | Propp | 118/13 |
| 2005/0076817 | A1 | * | 4/2005 | Boks et al. | 108/103 |
| 2005/0199622 | A1 | * | 9/2005 | Radow | 220/4.27 |
| 2005/0214418 | A1 | * | 9/2005 | Radow | 426/132 |
| 2006/0201417 | A1 | | 9/2006 | Radow | |
| 2007/0178195 | A1 | * | 8/2007 | Mauldin et al. | 426/106 |
| 2008/0245293 | A1 | * | 10/2008 | Fosmire et al. | 118/13 |
| 2010/0196546 | A1 | * | 8/2010 | Radow | 426/86 |
| 2011/0059214 | A1 | * | 3/2011 | Argondizzo et al. | 426/420 |
| 2011/0089128 | A1 | * | 4/2011 | Jin et al. | 211/163 |
| 2011/0127228 | A1 | * | 6/2011 | Sagel | 211/144 |
| 2011/0220599 | A1 | * | 9/2011 | Siahpush | 211/85.4 |
| 2011/0315648 | A1 | * | 12/2011 | Buttigieg | 211/163 |
| 2012/0114867 | A1 | * | 5/2012 | Quinn | 427/430.1 |
| 2013/0136829 | A1 | * | 5/2013 | Kandel | 426/132 |
| 2013/0228486 | A1 | * | 9/2013 | Buck | 206/459.1 |
| 2014/0014603 | A1 | * | 1/2014 | Thompson | 211/78 |

* cited by examiner

FIG. 21
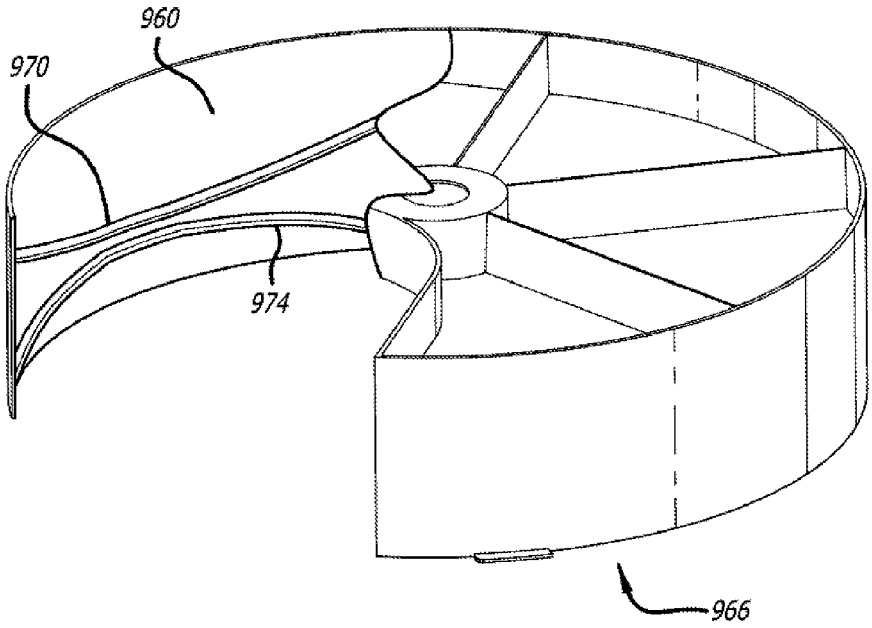
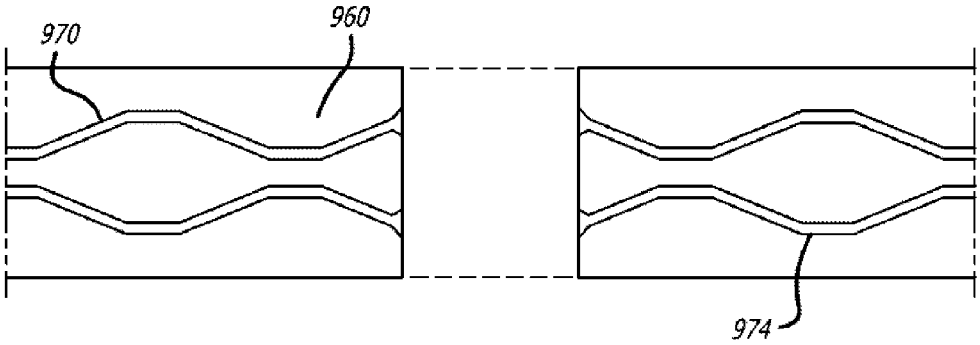
FIG. 22

FIG. 23
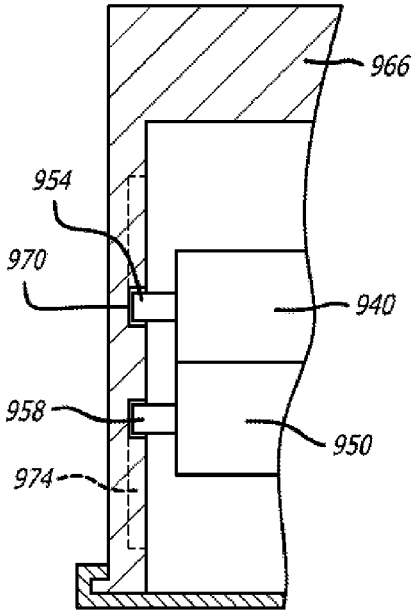
FIG. 24
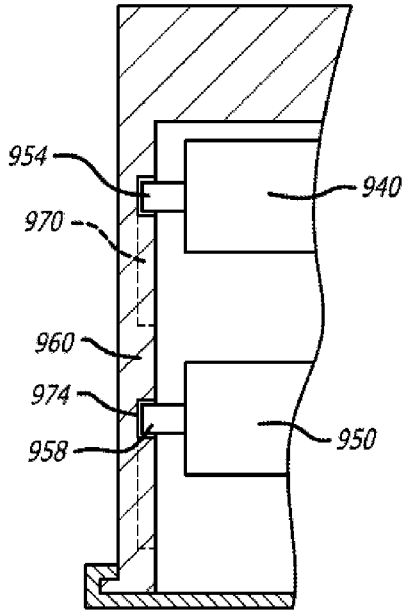
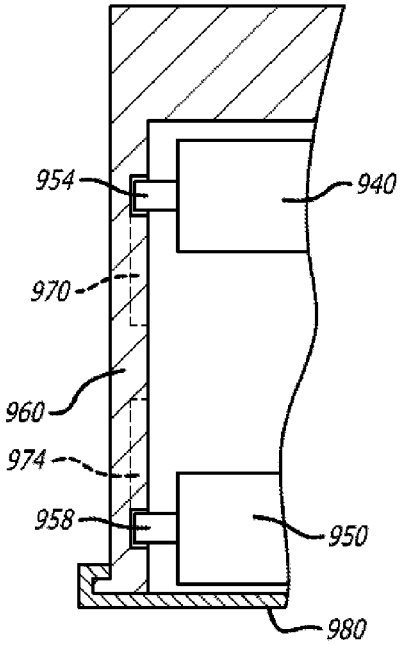
FIG. 25
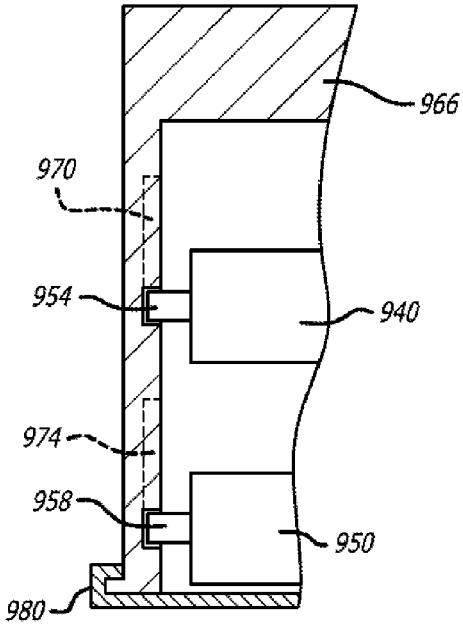
FIG. 26

DRINKWARE RIMMING APPARATUS AND METHOD

BACKGROUND

The present inventions relate to methods and devices/apparatus for applying edible dry granular, flaked, shaved or powdered substances (Spices) to the rims of drinkware. This process has been called glass "frosting" or "rimming."

"Rimming" beverage drinkware by itself is not novel. As an example, margaritas, which are cocktails made with tequila liquor mixed with lime, lemon and other juices and cordials, have been served in drinkware whose rims were coated with salt first in 1936, according to one story. This salted rim application was and is typically done by moistening the rim of the glass with an aqueous solution and then introducing the moistened rim into a dish or reservoir of salt.

Rimming drinkware has grown in popularity as restaurants, nightclubs, clubhouses, cafés, bars and taverns strive to improve consumer perception of drink values, reduce costs and/or offer unique presentations. Similarly, residential uses are increasingly promoted throughout the beverage industry with mixes and preparation techniques that enhance the beverages and/or entertaining value. In fact, a new field of study and area of expertise known as "mixology" has emerged in recent years.

Salt, as mentioned in the above margarita example, and similarly ordinary sugar, have fallen short of consumer and tradesmen expectations. Spices, however, with their bright colors, array of flavors and powerful aromas that may include expensive food science ingredients and preparations have captured the imagination of consumers, tradesmen and vendors. As a result, the number and complexity of different Spice preparations are practically unlimited these days. As an example, some of the various Spices that are currently available from the Roxi Group, Inc. of Reno, Nev., include Bloody Mary, Caesar celery, cinnamon graham, green apple, lemon, licorice, melon, pineapple/coconut, pomegranate, mint, watermelon, fruit shavings, chocolate shavings, precious metal and gems, and "exploding" spices.

Rimming devices ("rimmers") were originally designed for salt and sugar, both of which have no added ingredients. Since salt and sugar are relatively inexpensive, there has been little or no reason to handle them with special care, to protect them or to preserve them. For example, when cleaning such rimmers, excess salt or sugar can easily be discarded at little cost or waste, and saturated/damaged salt or sugar can similarly be discarded.

Rimmers are typically designed to accommodate only one or two Spice selections, such as salt and/or sugar. Neither salt nor sugar has distinguishing color or aroma characteristics so it is hardly noticeable by users and servers if small cross contamination occurs. On the other hand, by simply adding a colorant to either of these commodities, the slightest inadvertent migration/mixing of one into the other is immediately noticeable and thereby damages the product. As can be appreciated, manually separating the minute mixed Spice particles is not a practical solution.

Furthermore, contemporary rimmers typically do not separate a wetting reservoir, suspension materials and/or wetting agents away from the salt and sugar that may be housed in the device to avoid moisture contamination. It further is undesirable for the wetting agent, which adheres the Spice to the rim of the drinkware, to contaminate any of the Spices due to evaporation, spilling or other mishaps.

As mentioned above, new Spice formulations include costly flavors, colors and food ingredients for specific performance criteria. The preparations can be expensive, particularly when compared to salt and sugar. Vendors, tradesmen and consumers are reluctant to discard unused quantities and therefore endeavor to protect, preserve and fully utilize the Spices.

New beverage options enter the marketplace seemingly every day and continue to crowd bars and other beverage preparation areas. As a result, vendors are seeking to economize space, use every ounce of product and to maximize productivity, while offering exciting and diverse drink preparations. Conventional rimmers (designed for salt and sugar as described above) would force vendors to use many such rimmers or to use many individual Spice containers/dispensers to handle numerous Spices. Thus, these alternatives are undesirable in terms of their functionality, ergonomics and/or preservation of the Spice and space utilization. The concept of rimming beverages has suffered as a result of these inadequacies.

SUMMARY

The present inventions are directed to apparatus, kits and methods for applying an edible dry granular, flaked, shaved or powder substance to the rim of common drinkware and to provide ready access to two or more Spice selections. "Spice" herein includes any edible material intended to be affixed about the rim of an item of drinkware, including but not limited to an edible granular, flaked, shaved or powder material and/or a liquid or syrup. Spices can also include purely decorative substances.

An exemplary station, carousel or apparatus can house two or more Spice selections, separates and protects one Spice from the others, and separates and protects all Spices from the wetting reservoir, suspension material and wetting agent. The apparatus may also include storage areas for beverage adornments, condiments and garnish. In embodiments herein that include Spice liners the apparatus allows users to easily remove any one or all of the Spices from the apparatus for cleaning/exchanging and/or replenishing the Spices.

The footprint of an exemplary apparatus, with comparable geometries of individual receptacles, measured against contemporary rimmers is similar and proportional. However, accommodating greater numbers of receptacles, that is, many Spice variations, without occupying a larger footprint or jeopardizing functionality are among the advantages of the present inventions, especially in view of the unlimited possibilities of different Spice preparations.

Pursuant to an exemplary method and apparatus and generally speaking, a wetting agent is applied to the rim of drinkware to moisten it. Then with the drinkware inverted, its rim is introduced into one of the Spice selections. The Spice thereby adheres to the rim of the drinkware by virtue of the surface tension and kinematic forces present in the wetting agent on the moistened rim. Thus, disclosed herein are a novel and improved method and apparatus of dispensing or otherwise making easily available two or more Spice selections from the same device or apparatus in preparing beverages whose drinkware rims are coated with a Spice and similarly to apply the wetting agent by means of the same device or apparatus.

The apparatus may be an encompassing drinkware rimming system having the features and functions discussed above to conveniently and compactly accommodate, house and dispense two or more Spices and to apply the Spices to the rim of drinkware. The apparatus may include two or more pockets, indentations or contours (receptacles) on one or more levels or trays that rotate about a common axis, causing the receptacles to revolve or rotate in a generally circular direction, and orient toward a user in generally any three hundred and sixty degree direction (or in embodiments that include a cover a narrowed or specific orientation to users may be identified). The circular movement may be in either direction. These receptacles may depend down from a top surface of the tray, extend up from the surface or be in any position therebetween.

While one receptacle may reside on any level or tray of an exemplary apparatus, it is typically desirable that two or more receptacles be provided on a single tray. To maximize available space, receptacles may be located about a common axis. The post(s) at the axis may also serve as a turning, spinning or re-orientation user handling point(s). Depending on the shape of a receptacle, which may be circular, mirroring the shape of the rim of the vast majority of drinkware, an advantageous alignment of receptacles on a tray is two or as many as six, or even more. More receptacles may be aligned on a specific tray given the desired geometry of the receptacle and overall footprint of the apparatus.

The apparatus may include additional trays provided with more or fewer receptacles in varying sizes and with all of the trays vertically stacked. Each of these additional trays positioned above the first tray, that is, the second tray to the highest tray, may include a cutout feature providing vertical access down to the one or more trays positioned below the subject tray.

Such additional tray(s) and the first tray may rotate independently from the tray(s) above or below. Trays may be manipulated and rotated by a user who directly or indirectly contacts and moves a textured or ribbed outer peripheral edge of the tray. Specifically, a user may use a finger or utensil and apply a lateral and horizontal force in either direction (left or right) to turn the tray about its axis and in the desired rotational direction. Alternatively, as described above, a tray may be restricted to a clockwise movement or a counterclockwise movement. Outwardly protruding members attached to each of the rotating trays may be provided and which the user can manipulate to rotate the trays in lieu of or in addition to the above-mentioned textured or ribbed feature(s).

Alternatively, a user may grasp a vertically protruding center post of the apparatus, such as where the post is connected to the tray, and then twist the post to orient the tray as desired. Such twisting action applies a lateral and horizontal force to the left or the right, causing the tray to rotate about its axis to the left or the right. Alternatively as mentioned above, a tray may be restricted to a unidirectional movement pattern.

User contact points may be provided at the periphery of each tray and/or the center post as described above for rotating a given tray. Additional contact points may be installed about a tray. For example, from an initial turning point or a "ready position" where all second and subsequent tray cutouts are vertically aligned and perhaps oriented above a wetting reservoir of the lower tray, a user may apply a horizontal force against any tray's cutout area thereby causing that tray to rotate and expose its different receptacles.

Another example of a different handling point of the trays may be about the surface of a tray between receptacle locations. For example, texture or features may be provided to facilitate grasping, swiping or turning the tray to apply a rotating force to a given tray. Such rotation can expose and provide access to different receptacles depending on the orientation of the apparatus relative to the user and/or whether the apparatus has a cover that encapsulates or covers the receptacles and trays; that is, such rotation can align desired receptacles at a cutout area of the cover.

Each spice receptacle can receive a quantity of one Spice at a time, though two or more Spices can be received to form a Spice mixture, if desired. The amount of Spice can be one to sixteen ounces, for example, or four to nine ounces, or even more than sixteen. Further and as an example, a small system (or smaller receptacles in a larger receptacle system) intended to rim shot or "sample sized" glasses can be arranged with smaller receptacles (in diameter but not necessarily depth (height of the sidewall)) and therefore may hold lesser or greater volumes of Spice(s). A large diameter drinkware may hold significantly more Spice whereas the diameter of the receptacle may be much larger.

Spice(s) may be filled directly into the receptacles and/or pre-filled in contoured receptacle liners ("liners") that fit into contoured and shaped or if so desired hollowed (having open areas or through-holes) receptacles of a tray where the hollowed receptacle incorporates supports to hold the liner in the desired receptacle location. Examples of pre-filled liners are the RoxiSpice™ Cartridges available from the Roxi Group, Inc. of Reno, Nev. A cartridge is inserted into the receptacle, its top opened to expose the Spice and its bottom contoured tray supporting the Spice. That is, the liner may be filled with Spice prior to inserting into a receptacle and/or may be refilled while in a receptacle. Alternatively, a flexible liner, similar to a coffee filter, can be used.

The apparatus may provide for a drinkware wetting area (wetting reservoir or wetting receptacle) and separates this area from the Spice by housing the suspension material, such as a sponge, and a wetting agent, in a distinct and separate receptacle in the tray or at a distance from the Spice and located in a cover of the apparatus.

The sponge that holds the wetting solution may be operatively positioned in a removable tray or dish. The sponge or area that holds the solution to wet the rim of the drinkware can be removable. Thus in contrast to a prior art arrangement that is not removable, if the user wants to change or clean the wetting reservoir, he does not have to discard the entire contents of the unit, that is, throw away the Spice in the unit. He simply removes the dish, cleans it and replaces/replenishes the sponge.

In other words, according to an exemplary embodiment, the apparatus, its trays, receptacles and assembled components house the Spices and the wetting reservoir which accommodates the wetting agent. The receptacles, the liner, the trays and the cover protect the Spices and the wetting agent from cross contamination, damage and other mishaps.

The spice receptacles may be shaped and contoured so that the Spice when introduced into the receptacle flows by gravity to the periphery of the interior of the spice receptacle. This distribution effect causes the Spice to be more efficiently utilized when the moistened rim of drinkware is inverted and introduced into the receptacle. Specifically, the Spice may more completely extend over the drinkware rim, increasing yield per ounce of Spice and reducing potential waste of the remaining Spice in the receptacle.

A contoured liner may be inserted and fitted into the hollowed and/or contoured receptacle of a tray, thereby separating the receptacle of the tray from the Spice to better facilitate exchanging and/or cleaning leftover Spice from a particular receptacle. In either case, that is, hollowed or contoured, the liner may be pre-filled, re-filled, removed, discarded, cleaned and/or readily exchanged with the same or different Spice in any receptacle.

Similarly, the liner may also be contoured so that the Spice flows by gravity toward the periphery of the interior dimension of the liner. The Spice flows away from the raised center area of the liner, down its descents and toward the outer and interior dimensions of the liner, such as a ring or moat around the raised center area. This contouring provides greater contact area for the rim of an inverted drinkware that is introduced into a receptacle filled with Spice.

As discussed above, the apparatus may also provide for a wetting reservoir and if desired a suspension material, such as a sponge, for applying a wetting agent to the rim of the drinkware when drinkware is inverted and its rim introduced into the wetting agent. The wetting reservoir or receptacle may be contoured to accommodate a wetting dish. In either case, with or without the wetting dish, the wetting receptacle can hold the wetting agent ready for application to the rims of drinkware.

The rimming dish, wetting reservoir/receptacle and similarly the suspension material may be of descending depths so as to reduce the potential for spilling or overflow of the wetting agent when the wetting agent is introduced into the wetting reservoir when either the wetting dish and/or suspension material are present. Further, the descending depth of the wetting receptacle and wetting dish from that of the suspension material reduces the potential for overflow of the wetting agent when drinkware is introduced into the wetting receptacle, rimming dish or suspension material.

The wetting dish can be constructed with a thumb-and-finger grasp center post and a peripheral edge so that either location may serve as a handling point. The grasp center post can be elevated above the suspension material, the peripheral edge and the center ring that secures the suspension material in place in the rimming dish. The elevated height reduces the likelihood that the user accidentally contacts the suspension material or interferes with the wetting agent while handling these components. These handling points facilitate removal or replacement to refill, replace, discard, clean and/or readily exchange with a new rimming dish, wetting agent and/or suspension material.

The apparatus, trays, spice receptacles, liners and wetting receptacles may be manufactured in different sizes so as to accommodate small diameter as well as large diameter drinkware, such as a small shot glass style, larger martini or margarita style drinkware. For example, a small diameter may be one inch and a large diameter may be seven or more inches. Differing sizes of receptacles, liners and trays may also be incorporated into the apparatus.

A drinkware rimming apparatus in accordance with one of the present inventions can include: a first tray having a first spice receptacle and a second receptacle; and a second tray positioned above the first tray. The second tray can have a third spice receptacle, a fourth spice receptacle and an access cutout. The first tray and/or the second tray are rotatable relative to the other and about a vertical axis passing through the first and second trays so that the access cutout is in an operative position over the first spice receptacle, the second receptacle or another portion of the first tray as desired.

A drinkware rimming apparatus in accordance with one of the present inventions can include: a base; a tray supported by the base; the tray can have a first spice receptacle and a wetting receptacle; and a cover positioned over the tray and attached to the base. The tray is rotatable relative to the base and the cover about a vertical axis passing through a central area of the tray. The cover has an access cutout providing access to the first spice receptacle, the wetting receptacle or another desired portion of the tray by rotating the tray relative to the access cutout to a desired position.

A drinkware rimming apparatus in accordance with one of the present inventions can include: a first tray rotatable relative to a support surface of the apparatus and about a vertical axis; the first tray having (a) a first spice receptacle and (b) a second spice receptacle or a wetting receptacle; a second tray having a third spice receptacle; the second tray being positioned above the first tray and being rotatable about the vertical axis; and the second tray having an access cutout providing downward access to a desired portion of the tray.

A drinkware rimming apparatus in accordance with one of the present inventions can include one or more rotatable spice trays and a cover for the one or more trays. The cover can have compartments for storing beverage accessories and/or condiments (e.g., napkins, straws, picks and garnish, such as fruit pieces). The compartments can be removable so that the user can exchange, replace, refill and/or clean each one individually without discarding the contents of the other compartments. Additionally, the cover can have a cutout positioned above the one or more trays.

A drinkware rimming apparatus in accordance with one of the present inventions can include: a base; a tray supported by the base and rotatable relative to the base about a vertical axis; the tray can have a first spice receptacle and a second spice receptacle; and a cover positioned over the tray, attached to the base and having an access cutout providing downward access to a desired portion of the first tray.

A drinkware rimming apparatus in accordance with one of the present inventions can include: a first tray having (a) a first spice receptacle and (b) a second spice receptacle or a wetting receptacle; and a second tray having a third spice receptacle and a fourth spice receptacle. The first tray is rotatable relative to a support surface of the apparatus and about a vertical axis. The second tray is positioned above the first tray and is also rotatable about the vertical axis. The apparatus further includes a cam mechanism that, when at least one of the first and second trays is rotated relative to the other, lifts the second tray relative to the first tray at one indexing position and then lowers the second tray to another indexing position. The cam mechanism alternatively or additionally can raise and lower the first (lower) tray.

A drinkware rimming apparatus in accordance with one of the present inventions can include: a tray having a first spice receptacle and a second receptacle; a cover positioned over the tray; one of the tray or the cover being rotatable relative to the other and about a vertical axis passing through a central area of the tray and a central area of the cover; and the cover including a plurality of beverage garnish compartments on a top surface thereof. The second receptacle can be a wetting receptacle or a second spice receptacle. Alternatively, the wetting receptacle can be positioned on the cover.

A drinkware rimming apparatus in accordance with one of the present inventions can include: a tray having a wetting receptacle and one or more spice receptacles; the receptacles can be on the same vertical plane and positioned about a generally central rotation axis. The tray is rotatable about the axis to position one or more of the receptacles at a desired orientation relative to the user.

A kit in accordance with one of the present inventions can include: a drinkware rimming apparatus, which can include: a first tray rotatable relative to a support surface of the apparatus and about a vertical axis; the first tray can have a first spice receptacle and a second spice receptacle; and a second tray having a third spice receptacle; the second tray being positioned above the first tray and being rotatable about the vertical axis. The second tray can have a cutout providing downward access to a portion of the first tray. The apparatus may further include a wetting receptacle. The kit may also include a quantity of the first Spice for the first spice receptacle, a quantity of a second Spice for the second spice receptacle and a quantity of a third Spice for the third spice receptacle.

The above-mentioned kit may include a wetting dish for the wetting receptacle and a wetting sponge for the wetting dish, and may additionally include a container of wetting fluid for the wetting sponge. (The wetting fluid can be the Roxi-iSpice™ Rimming Syrup available from the Roxi Group, Inc. in Reno, Nev.) The kit may further include liners, dishes or cartridges for the first, second and/or third spice receptacles. The drinkware rimming apparatus of the kit may include a cover for the first and second trays with the cover having beverage garnish compartments on a top surface thereof.

A method in accordance with one of the present inventions can include: wetting the rim of an item of drinkware using a wetting receptacle of a drinkware rimming apparatus; rotating a tray of the apparatus so that a spice receptacle having a desired Spice therein is in an alignment position with an access cutout of the apparatus; and with the receptacle in the alignment position, manipulating the item of drinkware in the desired Spice in the receptacle so as to deposit the Spice on the wet rim. The access cutout can be in an upper tray and/or in a cover of the apparatus.

The method described above wherein the wetting uses a wetting receptacle of the apparatus.

The method described above wherein the wetting receptacle is in a cover or a tray of the apparatus.

The method described above further comprising after the manipulating the item of drinkware in the desired Spice, removing one or more garnish from a beverage garnish compartment in a cover of the apparatus, and positioning the garnish on, in and/or under the item of drinkware.

The method described above wherein the tray defines a first rotatable tray of the apparatus and the apparatus includes a second rotatable tray having a second spice receptacle, and the uppermost of the first and second rotatable trays has an access cutout.

The method described in the paragraph directly above wherein rotating one of the first and second rotatable trays relative to the other causes the second (or first) rotatable tray to lift from a first indexed position and then be lowered to a second indexed position relative to the first (or second) rotatable tray.

The method described above wherein the item of drinkware defines a first item of drinkware, the spice receptacle defines a first spice receptacle, the desired Spice defines a first desired Spice and the alignment position defines a first alignment position; and further including after the manipulating the first item of drinkware in the first desired Spice: (a) wetting the rim of a second item of drinkware using a wetting receptacle of the apparatus; (b) rotating a tray of the apparatus so that a second spice receptacle having a second desired Spice therein is in a second alignment position with an access cutout of the apparatus; and (c) with the second spice receptacle in the second alignment position, manipulating the second item of drinkware in the second desired Spice in the second spice receptacle to thereby deposit the second desired Spice on the wet rim of the second item of drinkware. A user can use or apply more than one Spice on the same rim. Additionally, one or more items of garnish and/or beverage accessories can be applied in, on and/or under the first and/or second items of drinkware.

The method described in the paragraph directly above wherein the tray defines a first tray and the apparatus includes a second tray above the first tray and including an access cutout, the wetting receptacle is in the first tray; and before the wetting the rim, rotating the first and/or second trays so that the wetting receptacle is aligned with the access cutout of the second tray.

A method and an apparatus for preparing drinkware where a substance is applied to the rim of the drinkware and substances can be dispensed from the apparatus. One apparatus includes a station that can house and dispense substances, which may either be filled directly into receptacles, pockets or contours and/or pre-filled in contoured compartments or separately in receptacle liners that fit into the compartments. The apparatus may include a wetting reservoir, and separates the wetting agent from the substance(s) intended to be applied to the drinkware rim by housing the wetting agent in a distinct location or in a separate receptacle. The wetting reservoir further can separate the wetting agent from the beverage accessories and garnishments by housing the wetting agent in a distinct location or in a separate receptacle or compartment.

Further objects and advantages of the present inventions will be apparent from the following detailed description of presently preferred embodiments with reference to the accompanying drawings.

BRIEF DESCRIPTION OF THE DRAWINGS

FIG. 21 is a perspective view of a cover of another two tray apparatus of the present inventions with a top portion of the cover broken away to show the two guide grooves on the inner surface of the sidewall of the cover;

FIG. 22 is an interior elevational view of the sidewall of the cover of FIG. 21 illustrated in a flattened condition and with the cover cutout in the middle;

FIG. 23 is a cross-sectional view of a portion of a drinkware rimming apparatus which includes the cover of FIG. 21, mounted to a base and having two trays in a first cammed position;

FIG. 24 is a view similar to FIG. 23 showing the trays in a second cammed position;

FIG. 25 is a view similar to FIG. 23 showing the trays in a third cammed position; and FIG. 26 is a view similar to FIG. 23 showing the trays in a fourth cammed position.

DETAILED DESCRIPTION OF EXEMPLARY EMBODIMENTS

Before explaining the present inventions in detail, it is to be understood that the inventions are not limited in their applications to the particular embodiments shown and/or described, since the inventions are capable of other embodiments. Also, the terminology used herein is for the purpose of description and not of limitation.

Figure 1:
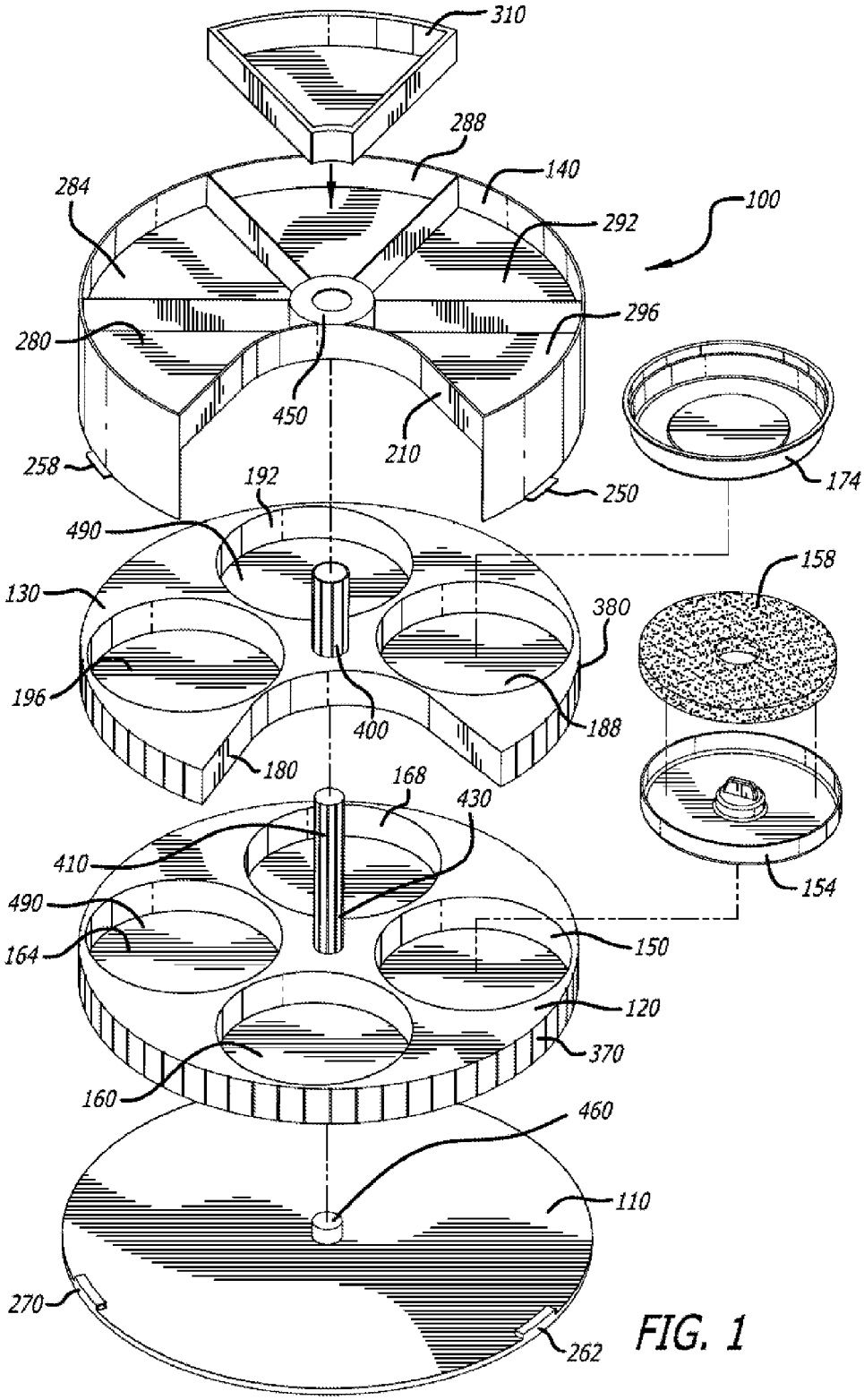
FIG. 1 is an exploded perspective view of an exemplary drinkware rimming apparatus of the present disclosure and also showing in exploded relation an exemplary garnish tray, an exemplary spice dish and an exemplary wetting dish with suspension material.
Figure 7:
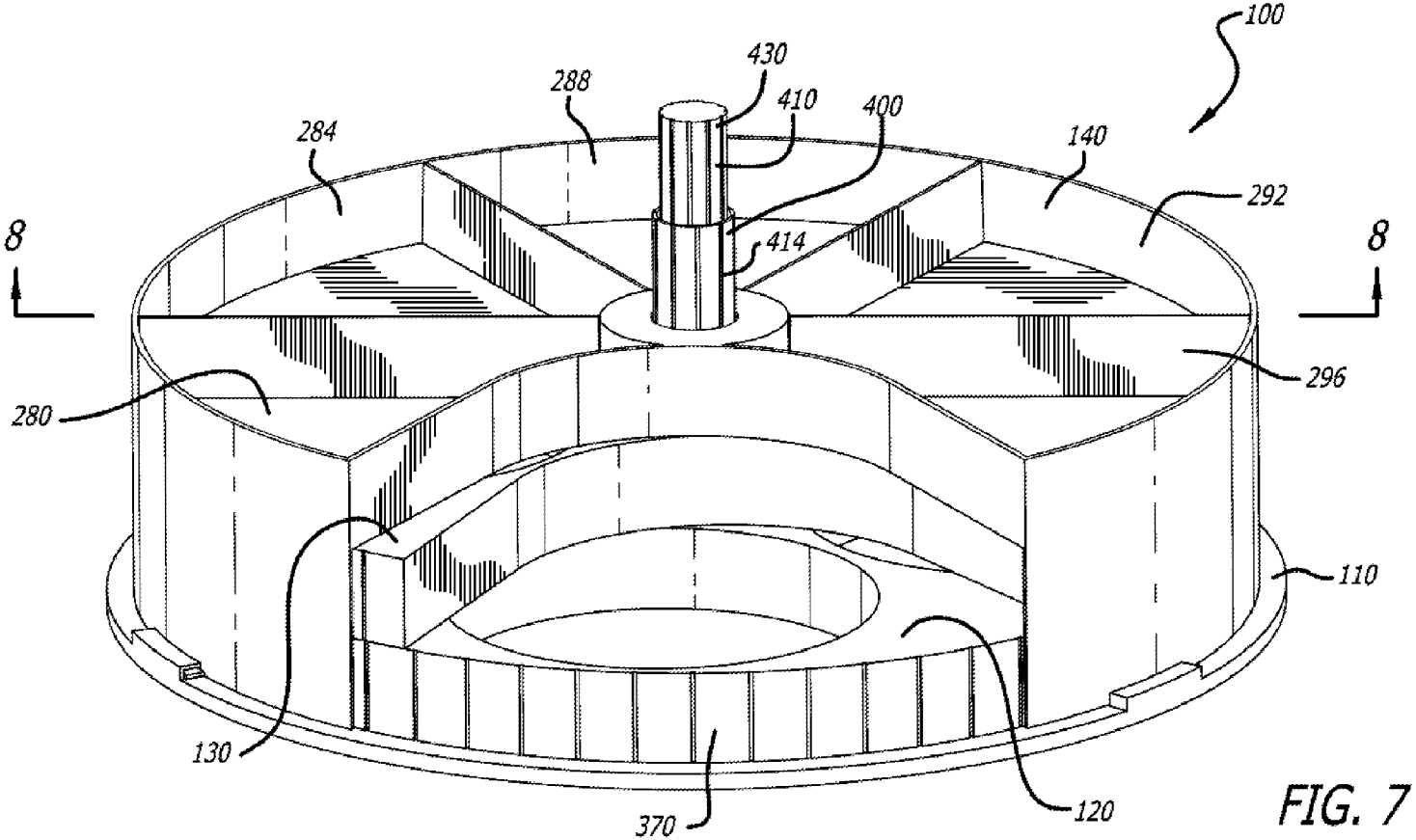
FIG. 7 is a perspective view of the apparatus of FIG. 1 in an assembled condition.
Figure 8:
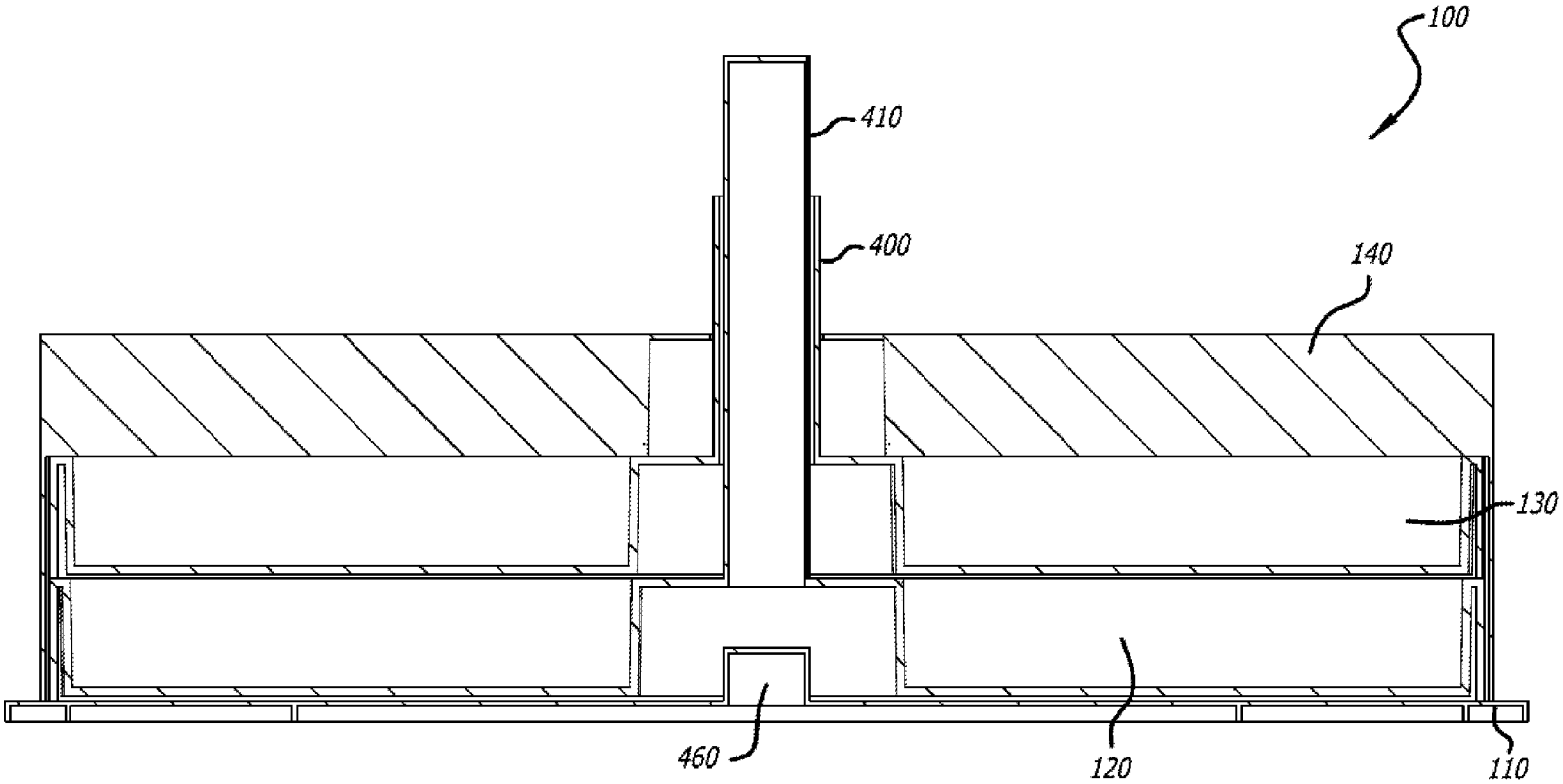
FIG. 8 is a cross-sectional view taken on line 8-8 of FIG. 7.

Referring to FIGS. 1, 7 and 8, for example, the station, carousel or apparatus shown generally at 100 can include a base 110, a first tray 120, a second tray 130 and a cover 140. The first tray 120 may have four receptacles, one of which can be a wetting receptacle 150 which receives a wetting dish 154 therein with suspension material 158, and the other three of which can be spice receptacles 160, 164, 168, each for receiving a spice dish 174 therein. (Alternatively, all four receptacles can be spice receptacles.)

Second (and subsequent) tray(s) 130 may accommodate a wetting receptacle and its assemblies. However, locating the wetting receptacle on the first tray 120 or on or about the cover 140 may be advantageous in terms of access and functionality. The second (and subsequent) tray(s) may each have an access cutout 180. The second (and subsequent) tray(s) 130 also may include one or more spice receptacles 188, 192, 196.

"Cutout" as used herein does not necessarily refer to the manufacturing technique (cutting) of forming it, but rather to the shape of the tray or cover, with a "recessed" area providing vertical access to a desired portion of a tray or the like beneath it. While the recessed area or cutout may be formed in a cutting process, another process is to form the tray or cover and its recessed area in a plastic molding process.

As an example, if four receptacles 150, 160, 164, 168 are provided in the lower tray 120 and three receptacles 188, 192, 196 in the upper tray 130, then the cutout 180 in the upper tray may be a generally ninety degree "slice," or more generally a slice between sixty and one hundred and twenty degrees. The edges of the cutout 180 from generally a central area of the tray to a periphery can be straight or curved, and more particularly outwardly curved or bowed, when viewed from above. Outwardly bowed configurations may allow for better access through the cutout 180 to a receptacle below it for an inverted item of drinkware.

The cover 140 may similarly have a cutout 210, and this cutout may also have bowed sides. When the cover cutout 210 and the second tray cutout 180 are vertically aligned, as depicted in FIG. 7, downward access is provided to the portion of the first tray 120 aligned with the cutouts. The portion, for example, can be any one of the three spice receptacles 160, 164, 168 or the wetting receptacle 150. The portion can be selected and changed by rotating the bottom tray 120 with respect to the upper tray 130 and the cover 140. When it is desired to provide access to one of the three spice receptacles 188, 192, 196 of the upper tray 130, the upper tray can be rotated until the desired spice receptacle is positioned at the cover cutout 210.

According to an exemplary embodiment the cover 140 includes a (rectangular) sidewall 230 extending from the top surface of the cover down to the base 110 and from one edge of the cover cutout 210 to the other.

The cover 140 can be attachable to the base 110 by a locking mechanism and numerous alternative locking mechanisms are possible. An exemplary embodiment is depicted in FIGS. 1, 2, 5 and 7, for example. It includes three male members (two of which are illustrated in the drawings at 250, 258), spaced from one another on the periphery bottom surface of the cover, and three female slots 262, 266, 270 on the periphery top surface of the base 110. To attach the cover 140 to the base 110, the cover is positioned on the base and rotated until the male members 250, 258 are positioned in respective female slots 262, 266, 270. To remove the cover 140, it is again rotated relative to the base 110, such as in the reverse direction, to disconnect the male members and female slots, and then lifted off of the tray(s).

Figure 2:
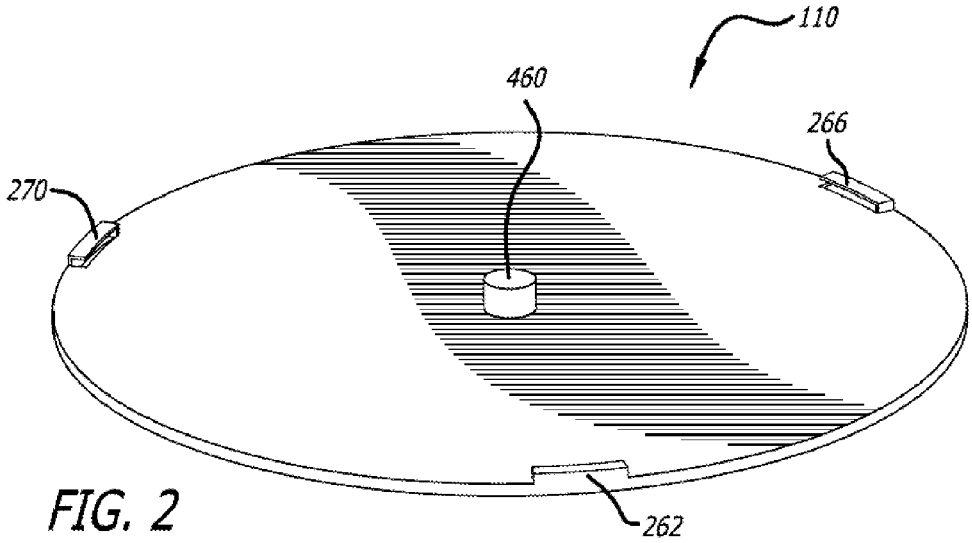
FIG. 2 is a perspective view of the base of the apparatus of FIG. 1.
Figure 5:
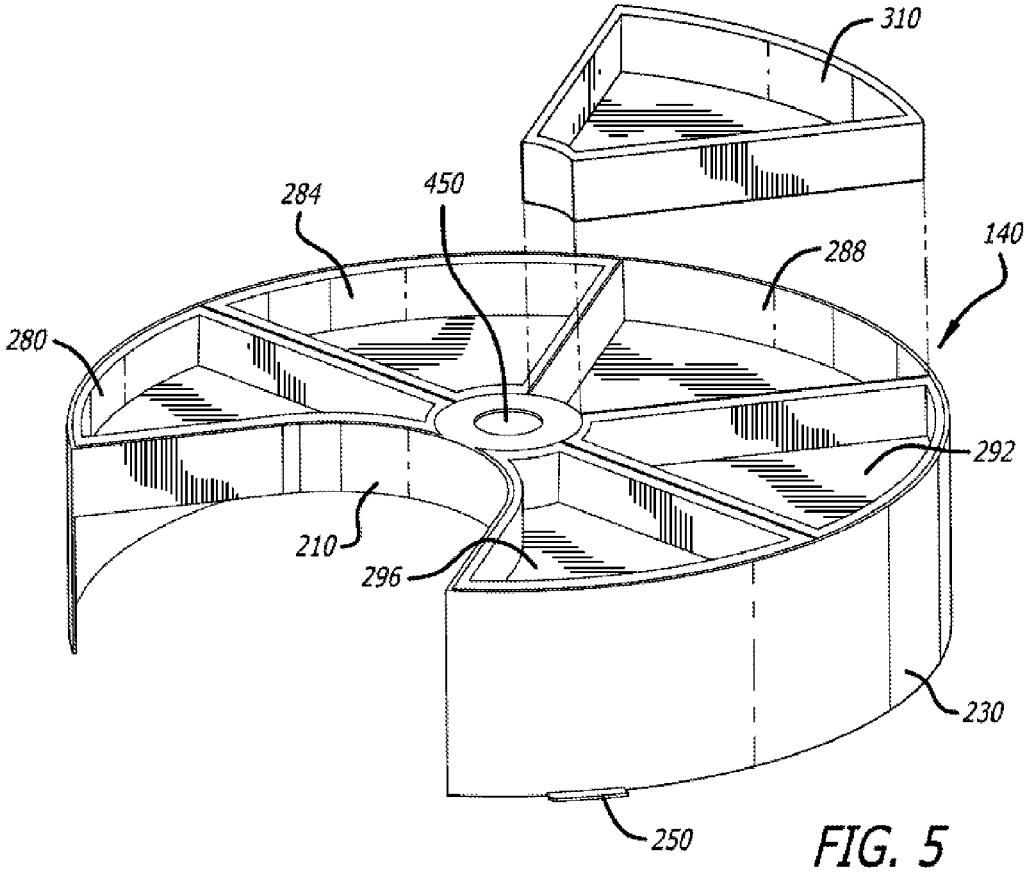
FIG. 5 is a top perspective view of the cover of the apparatus with one of the removable garnish trays or compartments shown in exploded relation and the other four in operative positions and showing a cover cutout; the quantities, shapes and sizes of the trays or compartments illustrated are only examples thereof.

That is, the cover 140, as depicted in FIG. 5, may include interlocking mechanisms that latch or otherwise affix the cover to the base 110 at the mating interlocks as depicted in FIG. 2. The cover 140 can be attached to the base 110 by any suitable means, aside from that described above, including without limitation an interlocking latch, a recess-protrusion arrangement, a guide slot, a snap-on device, mechanical fasteners, magnet(s), hook-and-loop and screw-on.

One or more cutouts are not needed for all embodiments of this disclosure. For example, an exemplary apparatus may include a single tray which is rotatable on a base. The tray has a plurality of spice receptacles and optionally a wetting receptacle. If the apparatus includes a cover, the cover can be retractable or liftable to provide access to one or more of the receptacles on the tray. Neither the tray nor the cover needs to include a cutout. If no cover is provided, the tray receptacles can have removable protective lids.

With the above-discussed single rotatable tray exemplary apparatus or other drinkware rimming apparatus the tray can include one or more garnish receptacles. Another alternative is for the base to include one or more garnish receptacles. For example, the base can extend out beyond the periphery of the tray and this base extension portion can include one or more garnish compartments. The base can extend out the entire periphery of the tray or only at one or more portions. Each of the garnish compartments can have removable covers.

While having base extension(s) may increase the footprint of the apparatus, having only one rotatable tray and/or no cover may decrease the height of the apparatus. This may have advantages where the apparatus is to fit in to an area with limited height, such as under a low hanging cabinet.

The base 110 can include support legs or feet. Alternatively, a stand or legs can be used in lieu of the depicted base to support the drinkware rimming apparatus on a support surface, such as on a countertop or the top of a bar. A further alternative is to construct the base and the lower tray as a single piece (see, e.g., FIG. 13).

Another alternative is that the trays include sidewalls (see, e.g., FIGS. 13-20) and the cover would not have any sidewalls. Rather, the cover can be positioned and lie across the top of the uppermost tray or may be attached to the center post.

Contemporary beverage preparations and presentations typically include various beverage garnish and serving articles including but not limited to straws, fruit/vegetable sticks, napkins, fruit/vegetable parts, spice sticks (cinnamon, chocolate, etc.) and so forth. Garnish containers are known in the prior art to house these items and make them available to servers in commercial and residential environments. However, these devices are units separate from any rimmers, consuming valuable bar space and often are "fit" into placements at a bar inconvenient to any rimmers.

The cover 140 further may include slots or storage areas or storage compartments on its top surface. Five generally pie slice shaped storage compartments 280, 284, 288, 292, 296 are illustrated in FIGS. 1 and 5. However, more or less than five (or even none) can be included. Similarly, the compartments can have configurations other than pie slice shapes. These storage compartments may be used to hold, separate and provide ready access to beverage garnish such as fruit wedges, fruit peels, vegetable sticks, olives, cherries, straws, toothpicks, napkins and the like. (A lime wedge from the compartment can be used as the wetting agent and applicator.) Each of these storage compartments can include a removable tray, an example of which is shown in FIG. 1 at 310. Being removable allows the trays 310 to be easily washed and/or to be filled or emptied at a location remote from the apparatus, if desired, or even replaced if damaged.

The lack of a systems approach in the prior art to creating a complete beverage apparatus has resulted in a multitude of devices scattered about a working bar area and inconveniently positioned relative to drinkware, sinks/wells, beverage ingredients and so forth. The present inventions can bring together all of the aforementioned elements required for modern beverage preparations; a dynamic drinkware rimming system and beverage service items and garnish in the same device, unit or apparatus and in a compact, user friendly and unique carousel-type arrangement.

Figure 6:
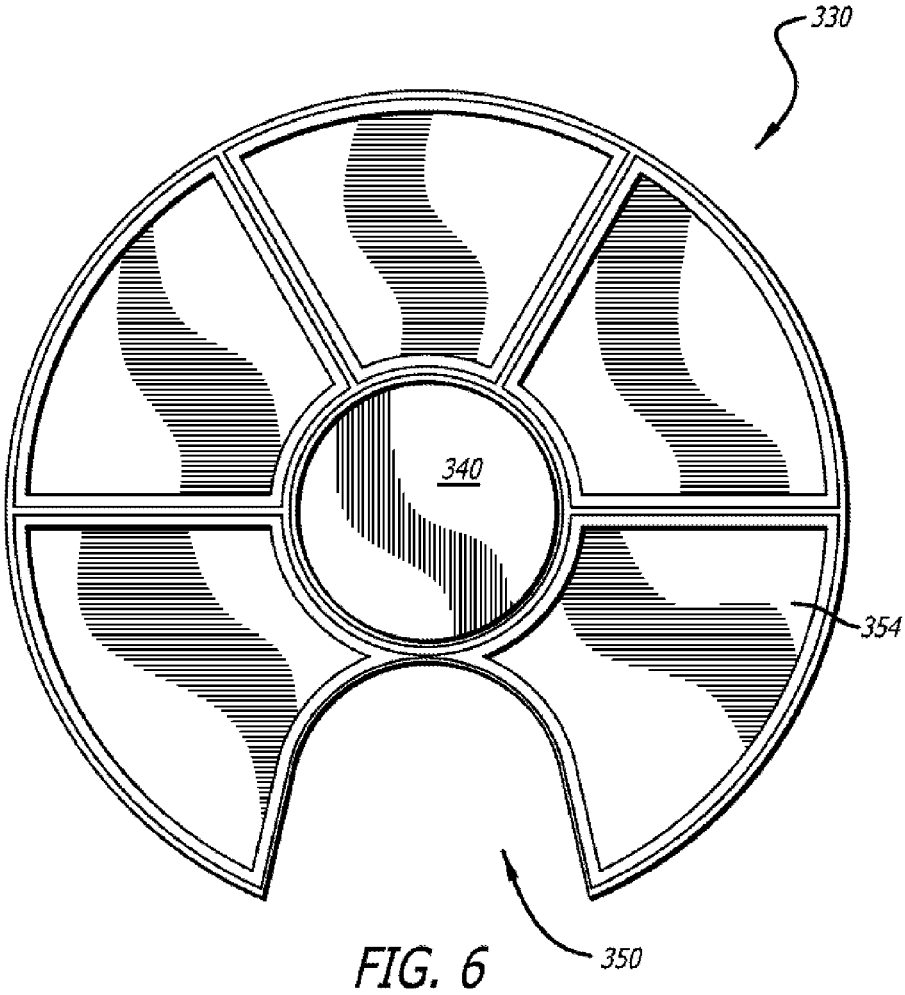
FIG. 6 is a top plan view of an alternative cover with a central wetting receptacle and (optional) garnish compartments around the wetting reservoir; the central wetting receptacle can alternatively be adapted and used as a garnish or other storage compartment.

An alternative cover 330 is depicted in FIG. 6 as having a wetting receptacle 340, a cutout 350 and five garnish storage compartments 354. The compartments 354 can each have a removable tray and be arranged around the wetting receptacle 340. However, it is also within the scope herein to omit the garnish storage trays or compartments on this alternative cover 330.

The cover 330 of FIG. 6 is shown without a center post opening. The handling points of the trays 120, 130 can easily be provided by, for example, the textured/ribbed peripheral edges 370, 380 of the trays depicted in FIGS. 1, 3 and 4 without the center post. (Such an embodiment can also define a single tray device if tray 130 is omitted.) However, such a cover can be configured with a center post opening to accommodate one or more posts and/or nested posts (see, e.g., FIG. 8). Furthermore, a suspension material which can be used is a "doughnut" shaped sponge and this sponge can be positioned so that the one or more posts and/or nested posts protrude through the "hole" of the sponge.

Figure 3:
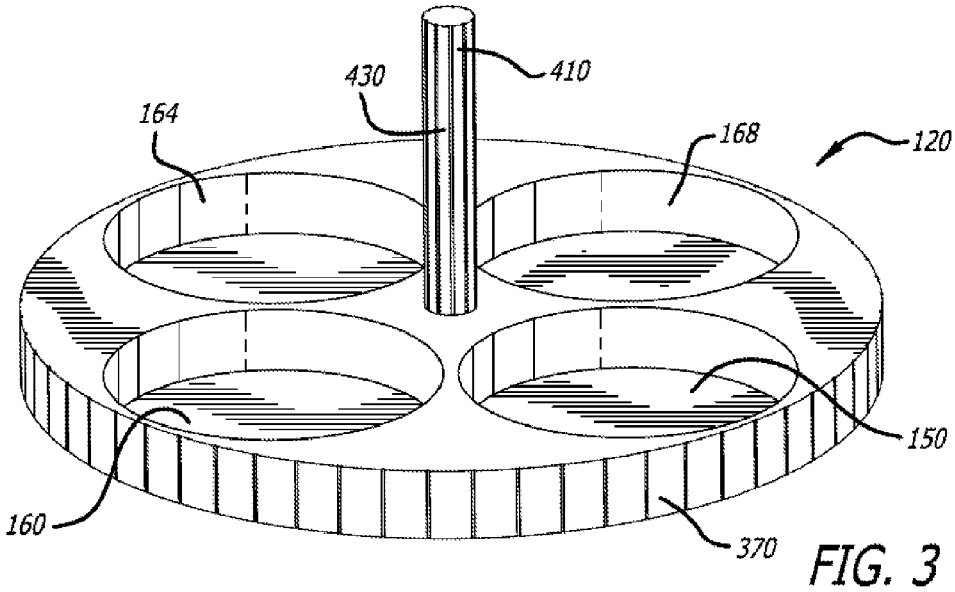
FIG. 3 is a perspective view of the first tray of the apparatus.
Figure 4:
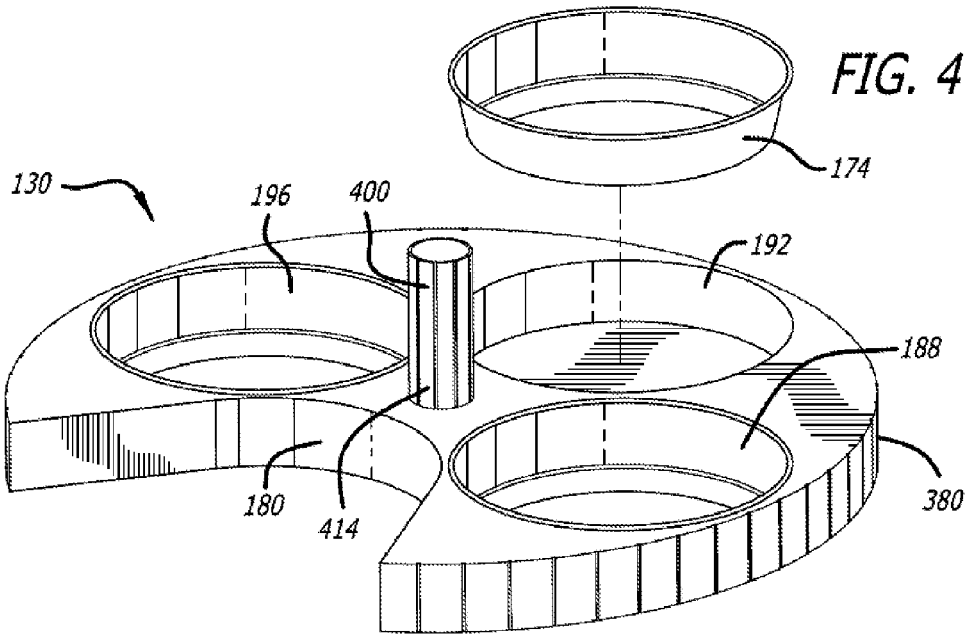
FIG. 4 is a top perspective view of the second tray of the apparatus with one of the spice dishes shown in exploded relation and showing a tray cutout.

FIG. 4 illustrates in isolation the second tray 130 of the apparatus with an exemplary spice dish 174 shown in exploded relation. The second tray 130 may include a vertical center nested post 400, which may be hollow and which may overlay the post 410 shown in FIG. 3, and as can be understood from FIG. 8. A user may rotate the second tray 130 at this nested post by contacting its textured or ribbed surface 414 so that different receptacles and/or the cutout of this tray may be oriented in a desired direction and/or relationship. Further, the tray 130 may be textured or ribbed 380 on its outer peripheral edge so that a user may likewise rotate or spin the tray.

FIG. 3 also illustrates that the first tray 120 may include a vertical central post 410 that has a textured or ribbed surface 430, providing a user contact surface to rotate or spin the tray 120 in a horizontal or substantially horizontal (see camming mechanism descriptions below relative to FIGS. 13-26) plane so that different receptacles may be positioned toward a user in any given direction. A user may rotate or spin the tray at these areas of the tray or other areas of the tray, such as areas on tray surfaces between adjacent receptacles. Features such as textures, indentations or protrusions about such areas and on other trays may serve as user handling, turning and/or spinning points.

The post and nested posts 400, 410 in FIGS. 3 and 4, respectively, may exit and protrude vertically above the cover post opening 450, providing access to these posts when the cover 140 is utilized with the apparatus 100. This is illustrated in FIGS. 7 and 8.

FIG. 2 shows that the base 110 may have a center knob, post, pivot or protrusion 460. The tallest center post 410 can be connected to or part of the first (lowermost) tray 120 and can also be the narrowest diameter post. This center post 410 can rotate about the knob 460 in the base 110. The second center post 400 can be connected to or part of the upper tray 130 and can be shorter than the first center post 410. Both posts 400, 410 can protrude upwardly through the post opening 450 and above the cover 140, as shown in FIGS. 7 and 8, so they can be accessed by the user.

It should be noted that the posts 400, 410 and the second tray 130 and subsequent trays, if any, are optional embodiments of the present inventions, and each can be accompanied with different variations of the cover. Other structures providing tray rotation can be used as would be apparent to those skilled in the art from this disclosure.

Other configurations for stacking and rotating one tray relative to the other tray(s), the cover and/or the base are within the scopes of the present inventions as would be apparent to those skilled in the art. For example, the trays 120, 130 (and/or the base or cover) can include mating arcuate ribs and grooves, where the rib of one tray rides in the groove of another tray, or vice-versa. The ribs/grooves can be positioned at or near the outer edges of the trays and/or near the center, such as where the posts 410, 400 are depicted. The posts can even be eliminated in this embodiment. Additionally, instead of ribs, one or more rolling elements can be used to provide one or more sliding surfaces.

A number of physical "touch support points" can be provided about the periphery of each tray 120, 130 so as to interact with the base below and the tray(s) below to support against downward pressure. These "touch support points" may also help facilitate the smooth rotation of each tray. These touch support points can be positioned so that each tray rests in the correct position so that the wetting receptacle and/or spice receptacles are positioned correctly at the cutout (s). Alternatively and similarly, second and higher trays may be supported via an interaction between the periphery of that tray and the inner sidewall of the cover so that the levels are "separated" and do not accidentally turn when turning a different tray. Another construction is to incorporate a ball bearing arrangement at each tray.

Figure 9:
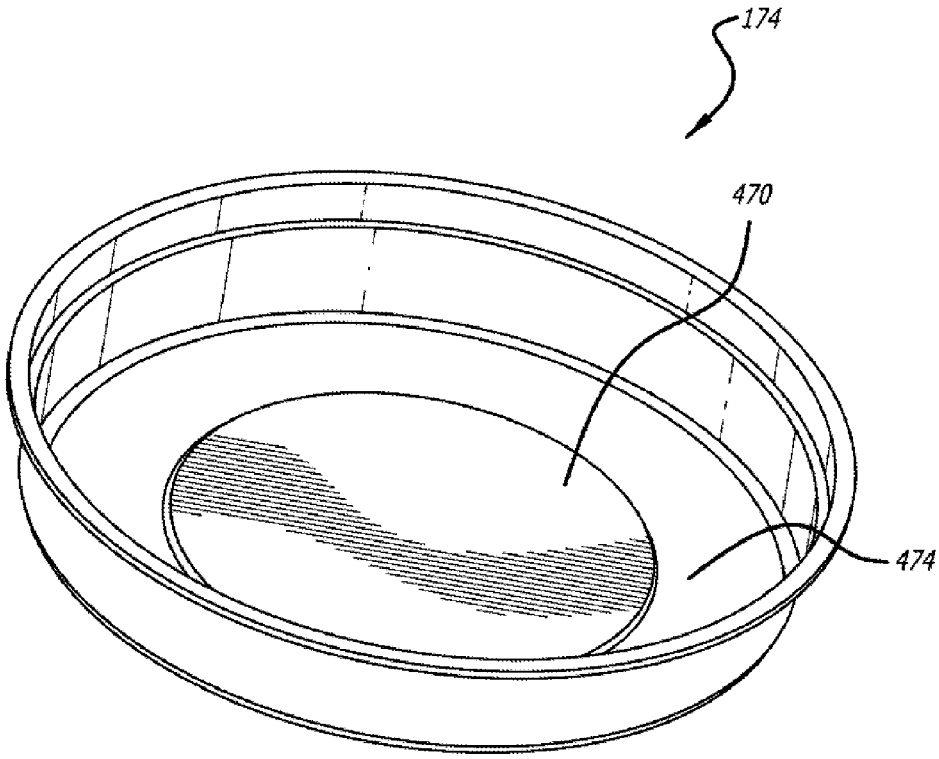
FIG. 9 is a top perspective view of a spice cartridge, dish or liner for use in a spice receptacle in a tray of an apparatus of the disclosure.

A contoured liner or dish is shown in isolation in FIG. 9 by reference numeral 174. The dish 174 may include a raised center area 470 such that Spice flows down its descents to a tray plane 474. The center area 470 can have a domed configuration. The Spice is thereby collected at the outer peripheral dimensions of the interior of the dish 174, such as in the plane 474 encircling the raised center area 470.

The diameter of each tray 120, 130 can depend on the diameters of the dispensers, receptacles or cartridges that hold the Spices (when used with a liner) or the size of the receptacle for the Spice in the tray. The diameters can also depend on the number of receptacles in each tray 120, 130. For example, it can be that the diameter of the tray is greater when the number of receptacles in the tray is large and/or when the diameters of the receptacles are large. As an example, when the tray has four cartridges/receptacles and each has a seven inch diameter, the tray may have a diameter of sixteen or so inches.

The diameters of the spice and wetting receptacles can be between two and ten inches, with an exemplary diameter being seven inches. An exemplary receptacle height can be between 0.25 and 2.0 inches.

The total height of an exemplary two tray apparatus, excluding the cover and the post extension out through the cover opening, can be between 2.75 and 4.0 inches where the cartridges have a height of approximately 1.25 inches. The height of the cover 140, post extensions 400, 410 and/or garnish storage receptacles 280, 284, 288, 292, 296 in the cover can increase this height.

Figure 11:
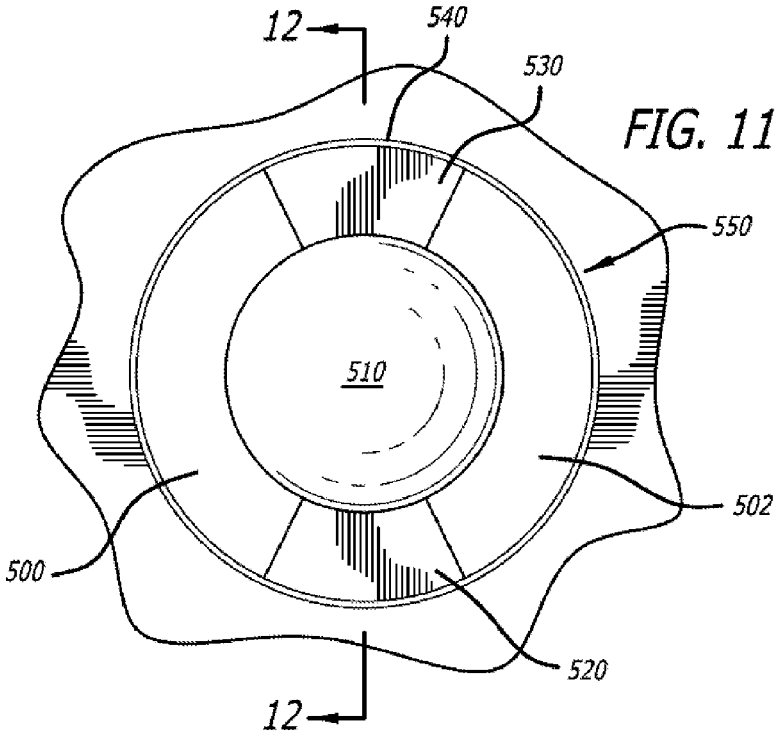
FIG. 11 is a top plan view of an alternative spice receptacle of a tray of an apparatus of the present disclosure.
Figure 12:
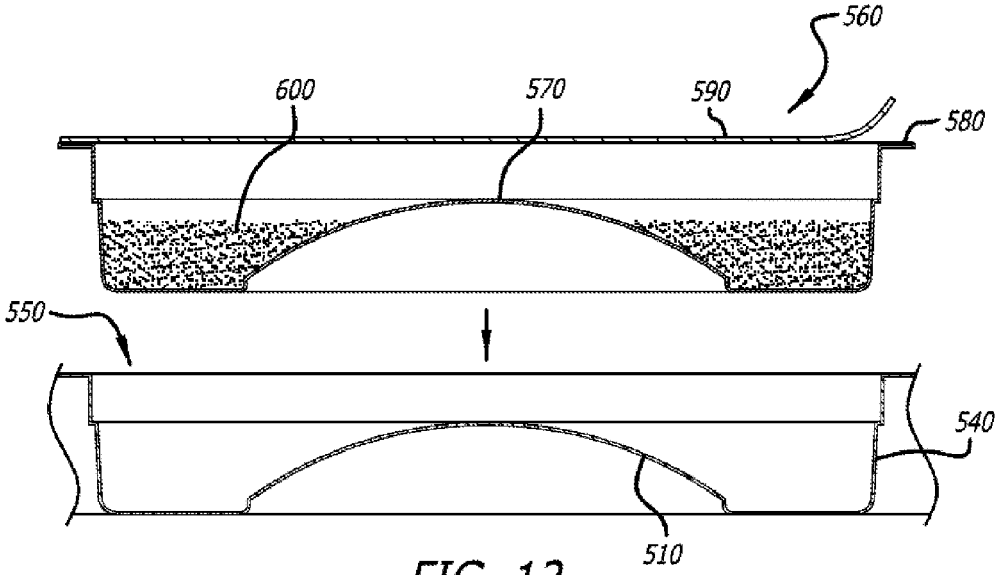
FIG. 12 is a cross-sectional view taken on line 12-12 of FIG. 11 and illustrating a spice cartridge being inserted into the spice receptacle and the lid being peeled off of the cartridge; the cartridge is similar to the dish of FIG. 9 and has Spice stored therein.

The spice (and wetting) receptacles can have flat depressed bottom surfaces, as shown in FIG. 1 at 490. An alternative construction is to have the bottom surface partially open as shown by reference numerals 500 and 502, except for a small domed area 510 in the middle and one, two or more struts 520, 530 connecting the domed area 510 to the sidewalls 540 of the receptacle 550. This construction is illustrated in FIGS. 11 and 12. Alternatively, the bottom can be fully open, and the dishes can have flanges supported by the tray surface adjacent the receptacle opening.

FIG. 12 shows a spice dish or cartridge 560 being inserted into the receptacle 550. The dish or cartridge 560 can have a domed bottom surface 570 to match that of the domed area 510 of the receptacle 550. It also can have a flanged rim 580 at the top to rest on the tray surface. FIG. 12 shows the cartridge having a lid 590, which can be peeled off (or otherwise removed) to expose the Spice 600.

Figure 10:
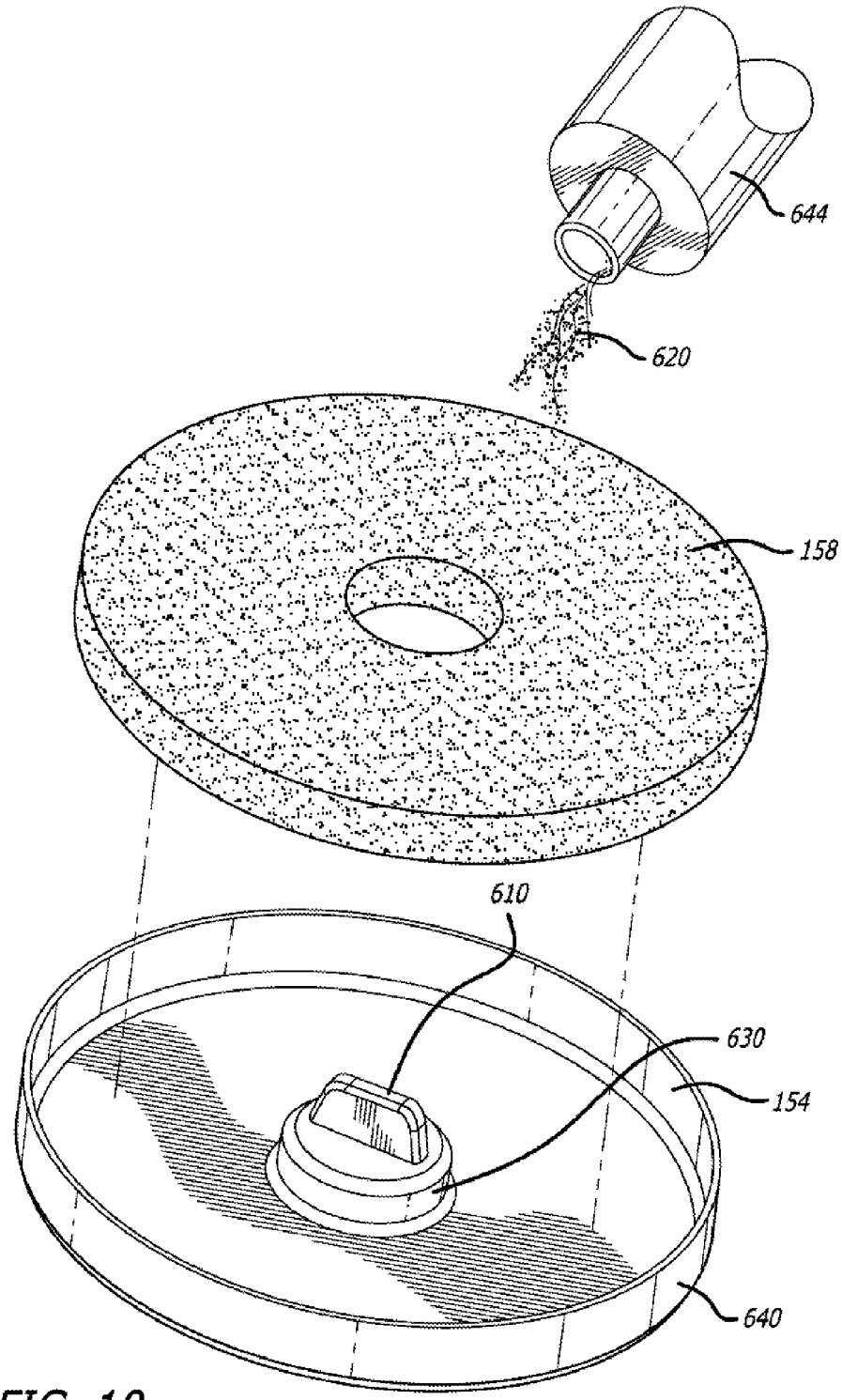
FIG. 10 is an exploded perspective view of a wetting dish and suspension material (sponge ring) for use in the apparatus and showing a wetting agent (syrup) being poured from a bottle/container onto the suspension material.

An exemplary wetting dish 154 and suspension material 158 are depicted in isolation in FIG. 10. The elevated grasp center post 610 of the wetting dish 154 can be positioned as a handling point above the height provided for the suspension material 158 so as to avoid unintentional contact by the user with the wetting agent 620. Similarly, the outer peripheral edge of the wetting dish 154 may have a flanged outwardly-protruding extension to more easily lift/remove/replace the wetting dish and to provide another user handling point so as to avoid unintentional contact with the suspension material 158.

One means to apply a wetting agent 620 to the rim of drinkware is by using a suspension material 158. The suspension material 158, for example, may be a sponge made from urethane or other absorbing substances. To hold the sponge 158 in the wetting dish 154 when drinkware is depressed and rotated and twisted about the sponge, the wetting dish can include a center ring 630. The suspension material 158 can be a sponge having a ring shape and fitting around the wetting dish's center ring 630 and inside the peripheral vertical walls 640 of the wetting dish.

An alternative device and method of applying a wetting agent to the rim of the drinkware is an applicator which a user uses to wipe the wetting agent on the rim. An example is disclosed in US 2008/0245293, entitled "Rim Moistening Applicator and Method." Referring to the abstract of that published application, a bottle contains a sticky liquid, which may be flavored and which may have a removable applicator. The applicator includes a handle, which may serve as a cap for the bottle, a stem and a swab. The swab is immersed in the sticky liquid and wiped around the rim of the drinkware. (This arrangement is similar to known glue jars, with brushes attached to the lids and extending down into the jar to access its contents when the lid is on the jar.) The rim can then be pressed into granulated flavoring material (Spice) to coat the rim. This applicator can supplement or replace the wetting receptacle/wetting dish 154.

A further alternative device and method of applying a wetting agent to the drinkware rim can be a hand-held applicator having a sponge or sponge like tip. This applicator can be similar to those used to apply liquid shoe polish to footwear. Options include that the tip is replaceable and/or that the applicator is refillable with new/additional wetting agent. The applicator can replace or supplement the wetting receptacle. A plurality of applicators can be provided or be available to the user. One or more may be replacement applicators should the primary one become empty or damaged. A further alternative is for applicators to have different wetting agents. The wetting agents, for example, can differ in their viscosity, their adhesive properties and/or their flavors. The apparatus can have a holder for holding one or more of these applicators, convenient to the spice receptacles.

The fluid 620 in the wetting receptacle can be water, juice (such as lemon, lime or orange), a simple syrup, an agave syrup, liqueur, honey, grenadine or the like. However, a preferred fluid is the RoxiSpice™ Rimming Syrup available from the Roxi Group, Inc. of Reno, Nev. This syrup is specially formulated to evenly bind Spices to plastic and glass drinkware. It can be poured from a bottle 644 onto the sponge 158, as shown in FIG. 10. The syrup has a neutral flavor so it can be used with any Spice flavor and beverage combination. It resists running and dripping down the drinkware and protects the Spice from clumping.

The following are steps of an exemplary method of the present inventions.

1. If needed, align the wetting receptacle of the apparatus with the cutouts of the apparatus.

2. Pour rimming fluid 620, such as RoxiSpice™ Rimming Syrup, onto the sponge 158 in the wetting receptacle until the sponge is completely covered.

3. Massage the rimming syrup into the sponge 158 with a utensil, such as a spoon or the rim or base of the drinkware.

4. Add syrup periodically to the sponge 158 to keep the sponge moist, especially if many items of drinkware are being rimmed.

5. Turn the drinkware upside down and dip the rim into the moistened sponge 158. Typical applications extend a half inch from the edge of the drinkware rim. Look at the drinkware rim to ensure a sufficient area is wet, but not dripping.

6. If the desired spice receptacle is on the upper tray 130, rotate the upper tray, if needed, until the receptacle is aligned with the access cutout 210 of the cover 140. If the desired spice receptacle is on the lower tray 120, rotate the upper tray 130, if needed, so that the cutout 180 of the upper tray is aligned with the cutout of the cover and rotate the lower tray, if needed, so that the desired spice receptacle is aligned with cutout of the cover.

7. Gently depress the moistened rim into the Spice 600 in the desired spice receptacle.

(If the drinkware has an aggressive flute, such as a Martini glass can have, to moisten the outside of the rim with the fluid/syrup, the glass may need to be tilted on its edge and the rim twisted into the sponge to wet both the inside and outside of the rim, evenly and smoothly. Then, with the glass tilted the rim is rolled in the Spice, so that the inside and outside of the rim are both depressed into the Spice.)

8. Hold the drinkware upside-down and tap it to knock off any loose Spice.

9. Fill the drinkware with the desired beverage to just beneath the spiced rim.

10. Before and/or after filling the drinkware with beverage, add desired beverage garnish to the rim and/or in or under the drinkware. Garnish can be obtained from compartments 280, 284, 288, 292, 296 on top of the cover 140.

An exemplary drinkware rimming apparatus 100 thus can have numerous receptacles within a compact space. Each of the receptacles can be for a different Spice or more than one receptacle can hold the same Spice, especially for a more popular Spice. For an apparatus having a cover 140, a top tray 130 and a bottom tray 120, and three spice receptacles 188, 192, 196 and a cutout 180 on the top tray and three spice receptacles 160, 164, 168 and a wetting receptacle 150 on the bottom tray, receptacles for six different Spices can thereby be provided in a compact area. This is an efficient arrangement of similarly sized receptacles (whether circular or square) about a center post and/or within a defined round area. Most drinkware have a mouth opening less than six inches in diameter, and thus a corresponding receptacle may be seven inches in diameter. This area has a footprint of approximately two hundred square inches (eight inches squared by 3.14) and a height (not including the post extensions above the top surface of the cover 140) of approximately five inches. This height does not include areas on the top surface of the cover for either a wetting receptacle 340 or garnish compartments (FIGS. 5 and 6).

If the apparatus includes more than two trays, each additional tray can have three spice receptacles and a cutout. (Another configuration can have five receptacles on the lower tray and four receptacles and one cutout on each of the upper trays.)

To position and provide access to a different spice receptacle, the trays 120, 130 can be rotated. Unlike pulling drawers out of a drinkware rimming cabinet or fanning out receptacles from a pivot point to access different receptacles (see, e.g., U.S. Pat. No. 3,450,096 entitled "Glass Frosting Device"), rotating trays about a central axis does not increase the space occupied by the (carousel-type) drinkware rimming apparatus.

As an example, for comparison purposes, the RoxiSpice™ Rimming Tower has five drawers, each having one spice receptacle, and a wetting receptacle on the frame's top surface. The RoxiSpice™ Rimming Tower was first sold on or about 2007. This rimming tower with one of its drawers pulled out (and adding a sufficient area to counter leverage the torque of the downward forces and sufficient extension to fully access exposed Spices) has a footprint of approximately one hundred and seventy-one inches (nineteen inches by nine inches) square inches and a height of approximately eleven inches. Additional height is needed to access a wetting receptacle on the top surface of the frame, above the drawers, or when all drawers are closed, a foot or other area in the base can be utilized to house the wetting receptacle, but this would occupy additional space when the drawers are closed. (An example of another rimming apparatus having multiple spice receptacles is disclosed in U.S. 2006/0201417, entitled "Dispenser Cabinet.")

An exemplary drinkware rimming apparatus of this disclosure can have compartments 280, 284, 288, 292, 296 on a top cover 140 to store and provide ready access to an assortment of beverage garnish. A wide variety of garnish is typically used to decorate and accompany beverages, and examples of garnish are fruit peels, fruit wedges, vegetables, spice sticks, straws, picks and napkins. An exemplary apparatus herein organizes, stores, displays and provides ready access to all of these beverage garnishes and in the same compact apparatus that has all of the spice receptacles and the wetting receptacle.

Each of the Spices can be packaged in individual cartridges 560, as shown in FIG. 12. The cartridges 560 can be made of a reusable and washable plastic material. Alternatively, the cartridges 560 can be made of a compostable, disposable non-reusable material, such as paper, wood pulp, sugar cane or bamboo; the compostable material can be partially flexible or brittle. The Spice 600 can be sealed in the cartridge container by a lid 590 that is heat or induction affixed to the rim of the container. The user can peel the lid 590 off to expose the Spice 600 contents of the cartridge 560, with the cartridge in the spice receptacle or immediately before being positioned in it.

Alternatively, the Spices 600 can be provided to the user enclosed in respective bags and optionally the bags provided positioned in an open-top dish or cartridge 174, such as that illustrated in FIG. 9. The user opens the bag and pours the Spice 600 into the cartridge or dish 174, either before or after positioning the cartridge or dish in the spice receptacle.

Labels can be provided to indicate the name/type of Spice in one or more of the spice receptacles. For example, a removable adhesive label with the name of the Spice on it can be removed from the liner, cartridge or spice container and placed adjacent the corresponding spice receptacle. Another "labeling" system can be a color-coded system where a different color patch adjacent to or on the receptacle would be associated with a different Spice. The user then would become familiar with the color association. A further labeling system can be where the user simply identifies/recalls the location of different Spice selections within the apparatus or observes the different colors selected and placed into the apparatus.

As mentioned above, the wetting receptacle 340 can be positioned on the cover 330, as shown in FIG. 6, or the wetting receptacle 150 can be positioned in one of the trays, as shown in FIG. 1. Positioning it on/in the lower tray 120 is an efficient use of space since the lower tray can have four positions, while the upper (and subsequent) tray(s) can have three positions due to the access cutout(s) 180. When not in use (and stored overnight for example), the apparatus 100 can be "closed" whereby the wetting receptacle 180 is aligned at the cutouts 186, 210 and the Spices in the spice receptacles are covered by an upper tray or the cover. The sponge 188 can be removed from the dish 174 for cleaning and the Spices 600 are protected inside and under the cover 140.

The present station or apparatus 100 thus can provide easy access to a plurality of Spices, economizes available bar space, protects and preserves the Spices and in at least one embodiment may combine storage areas for other common drinkware preparation adornments, condiments and garnish such as fruit, fruit wedges, vegetables, straws, napkins, picks and so forth. The station or apparatus embodies these features when applying a Spice 600 to the rim of drinkware for beverages of generally any type, nature, alcoholic or non-alcoholic. In addition to cold drinks, the apparatus can be used to apply Spices to rims of hot beverages, both alcoholic and non-alcoholic. And examples of these hot drinks are coffees, teas, hot chocolates and ciders, and popular Spices for the hot drinks are chocolate, cinnamon, vanilla, anise and fruit spices, such as lemon, raspberry and mango.

The apparatus 100 can include resilient members such as bumps on the trays (or the cover or the base) which engage in corresponding recesses in an adjacent tray (or the cover or the base) to provide indexed stopping positions for the tray(s) to align the receptacles relative to the cutout(s). The stopping force of the resilient members in the recesses can be easily overcome by further turning of the tray to reposition the tray.

It is also within the scope of the present inventions for one or more of the trays of the apparatus to lift up when being turned between rotation positions and then to rest downward when the tray is in the next position. This allows the trays to be more easily rotated relative to one another and to protectively seal or close the receptacles when the trays are in the aligned or desired position for a rimming operation or when in a storage condition.

An exemplary embodiment of this lifting/lowering includes a series of members on a top surface of a lower tray and a conversely matching series of members on the bottom surface of an upper tray. These members may be near the outer edge or circumference of the trays and between adjacent receptacles. Each member can include a first (up) ramp, a plateau/peak and then a second (down) ramp toward a valley. The upper tray can include on a bottom surface thereof a plurality of spaced bumps (peaks or plateaus and valleys) or the like. Thus, when one of the trays is rotated relative to the other, the upper tray rides up the first ramp, along the plateau and then down the second ramp to advance to the next receptacle position.

For example, in an apparatus where there are three stacked trays (lower, middle and upper trays), a "normal" position can be for the trays to be essentially against one another with little or no space between them to cover and protect the Spices in the receptacles. The middle and upper trays can have cutouts. Rotating the upper tray to operatively position one of its receptacles causes the upper tray to ride up and down on one or more ramps between the upper and middle trays. To reposition the middle tray relative to the top tray, the middle tray can be turned by its upwardly protruding center post or by rotating the center tray by its periphery. Similarly, to reposition the bottom tray relative to the middle and top trays, the corresponding center post can be turned or the periphery of the tray can be swiped.

Thus, an alternative embodiment apparatus is illustrated in FIGS. 13-20 generally at 700. Apparatus 700 can include a lower tray 710, a middle tray 720 and an upper tray 730. Each of the trays can include a plurality of receptacles 740, and the middle and upper trays 720, 730 can have respective cutouts 750, 760. Each of the trays can have a central post 770, 780, 790, which stack similar to the arrangement of FIG. 8. While the base 800 is illustrated as a flat round disc integral with or attached to the lower tray 710, other "base" constructions as would be apparent to those skilled in the art are within this disclosure. Also, while three trays 710, 720, 730 are illustrated, more or fewer trays can be used. Further, while the apparatus is illustrated as not including a cover, covers such as illustrated in FIG. 5 or 6 can be used.

One of the receptacles of one of the trays can be a wetting receptacle, such as lower tray receptacle 810, and can hold a wetting dish, and the rest of the receptacles can be spice receptacles. The wetting receptacle can be one of the four receptacles in the bottom tray, for example. If a cover is provided, the wetting receptacle can be supported in the top surface of the cover, such as shown in FIG. 6 at 340. If the cover 140 of FIGS. 1 and 5, which is shown to include garnish compartments 280, 284, 288, 292, 296 and no wetting receptacle, is used then the wetting receptacle can be one of the tray receptacles, such as 810.

An exemplary apparatus of the present disclosure can include camming mechanisms on the trays to cause a lifting and lowering action of one or more upper trays relative to one or more lower trays beneath them, as the one or more upper trays are rotated relative to the lower trays. With all of the trays in a "lowered" position, the one or more upper trays are positioned in a first indexed position relative to the one or more lower trays therebeneath. They are then lifted, rotated and lowered to a second indexed position. Typically, the second indexed position represents a rotation from the first indexed position to the next receptacle position. For example, if the tray in question includes four equally spaced receptacles, then the rotation angle between the first and second indexed positions will be generally ninety degrees.

Figure 13:
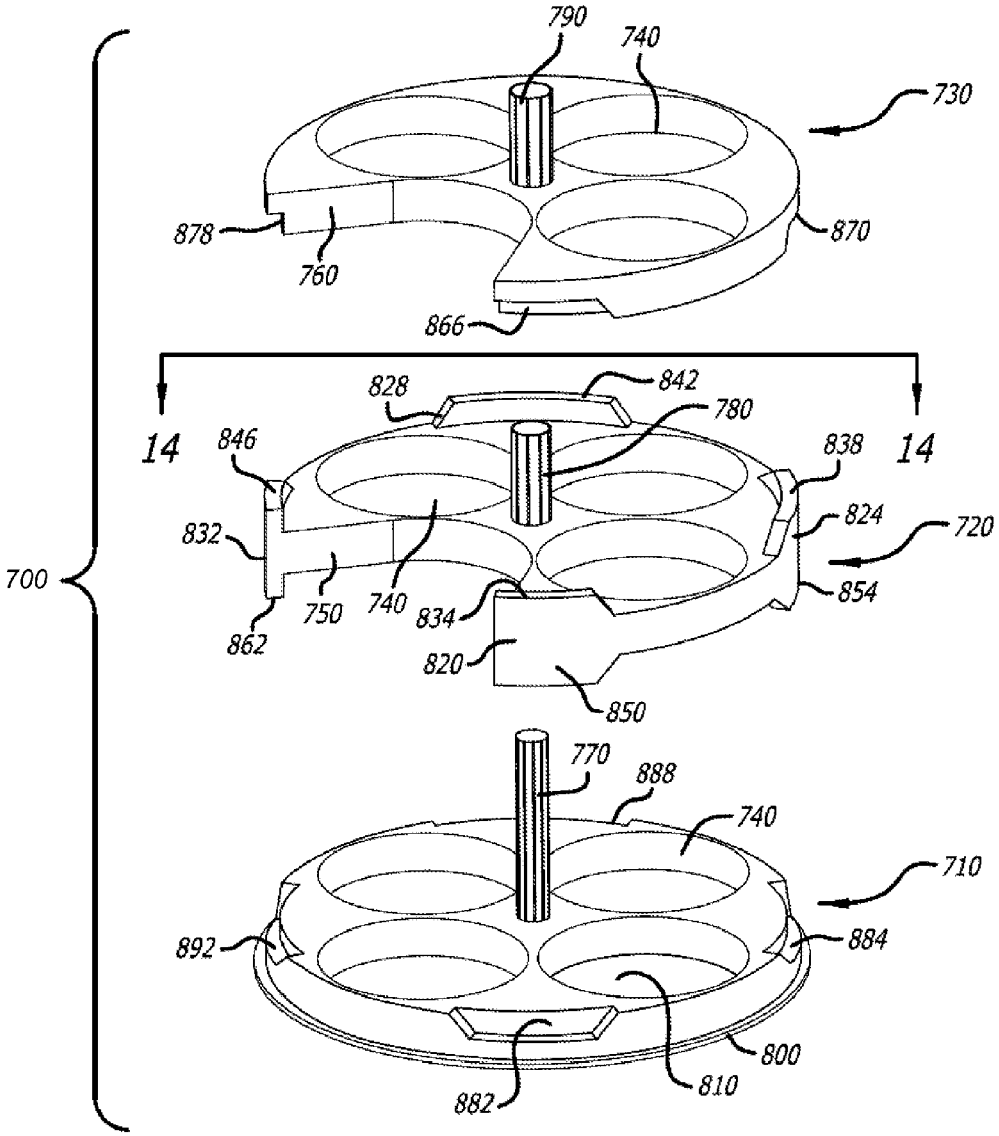
FIG. 13 is an exploded perspective view of an alternative apparatus of the present inventions.
Figure 14:
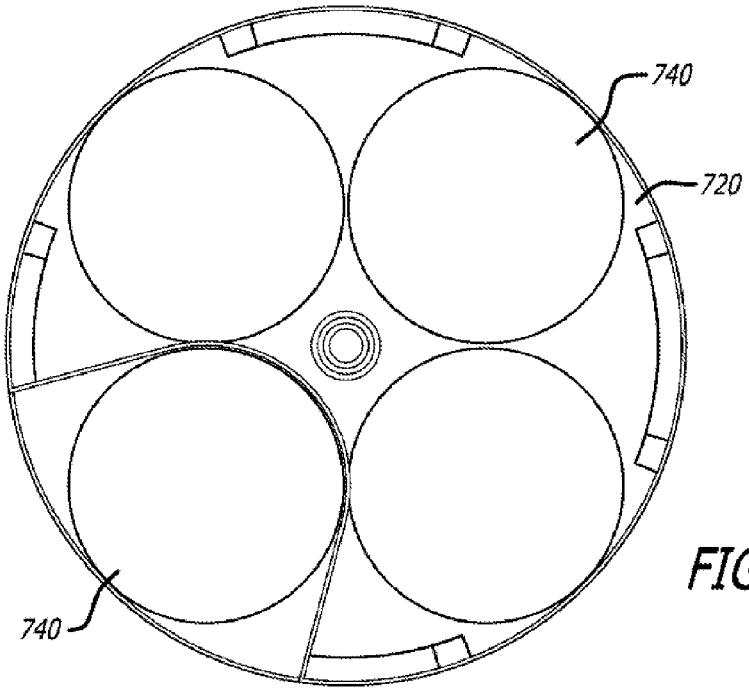
FIG. 14 is a top plan view taken on line 14-14 of FIG. 13.
Figure 15:
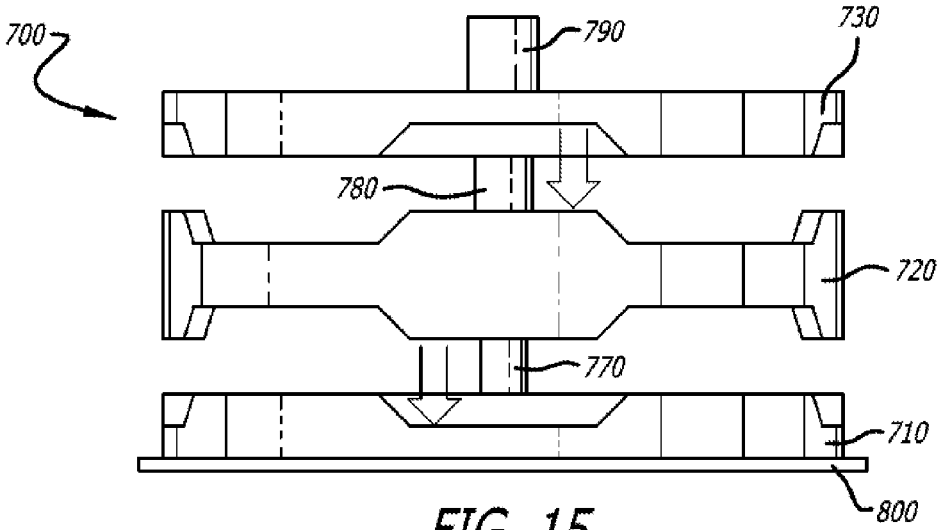
FIG. 15 is a side elevational view of the apparatus of FIG. 13 showing the trays thereof in a partially separated relationship.

Referring for example to FIG. 13, the camming mechanism can include a plurality of male members 820, 824, 828, 832 on the perimeter of the middle tray 720. Each of the male members includes a respective upper portion 834, 838, 842, 846 extending above the plane of the main top surface of the tray and respective lower portions 850, 854, 858, 862 extending below the plane of the main bottom surface of the tray. The camming mechanisms further includes a plurality, e.g., four, of spaced recessed female areas 866, 870, 874, 878 on the bottom of the perimeter of the top tray and a plurality of spaced recessed female areas 882, 884, 888, 892 on the top of the perimeter of the bottom tray. The camming mechanism members can be greater or fewer in number and may or may not correspond to the number of receptacles in any one or more of the trays.

For each indexed position, the upper portions 834, 838, 842, 846 of respective ones of the male members fit into different ones of the female areas 866, 870, 874, 878 on the top tray and the lower portions 850, 854, 858, 862 of respective ones of the male members fit into different ones of the female areas 882, 884, 888, 892 on the bottom tray. This can be understood from FIGS. 13, 15 and 16. As also can be seen in those figures, each of the male members and each of the female areas have opposing ramped/inclined/slanted ends on opposite sides of plateau surfaces.

Figure 16:
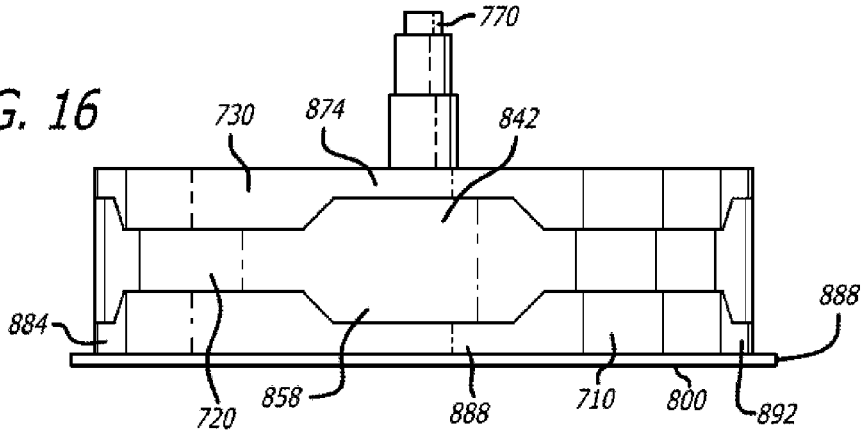
FIG. 16 is a view similar to FIG. 15 showing the apparatus assembled and in a first indexed position.
Figure 17:
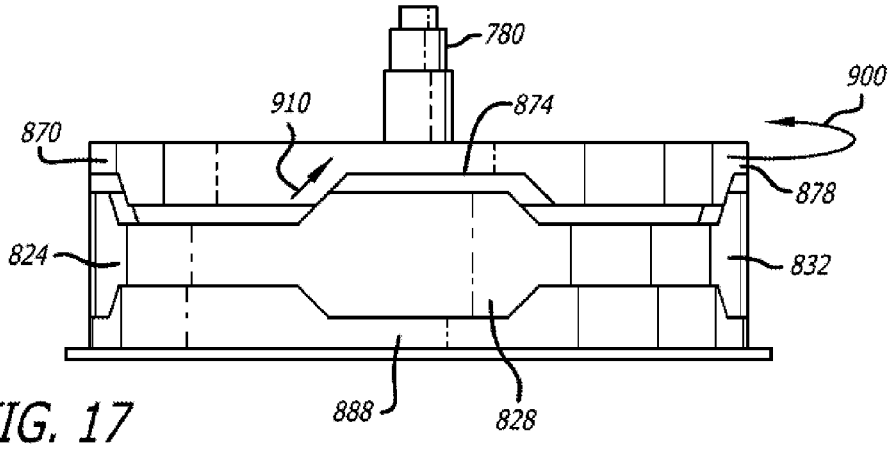
FIG. 17 is a view similar to FIG. 16 showing the top tray being rotated relative to the middle tray.
Figure 18:
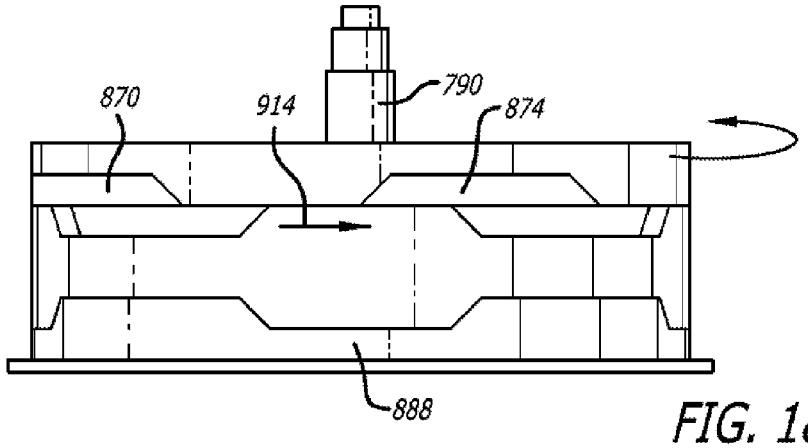
FIG. 18 is a view similar to FIG. 17 with the top tray in a further rotated position.
Figure 19:
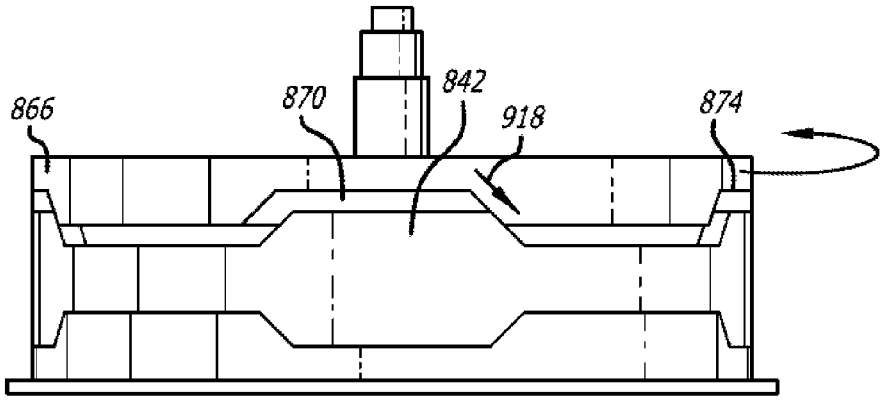
FIG. 19 is a view similar to FIG. 18 with the top tray in a still further rotated position.
Figure 20:
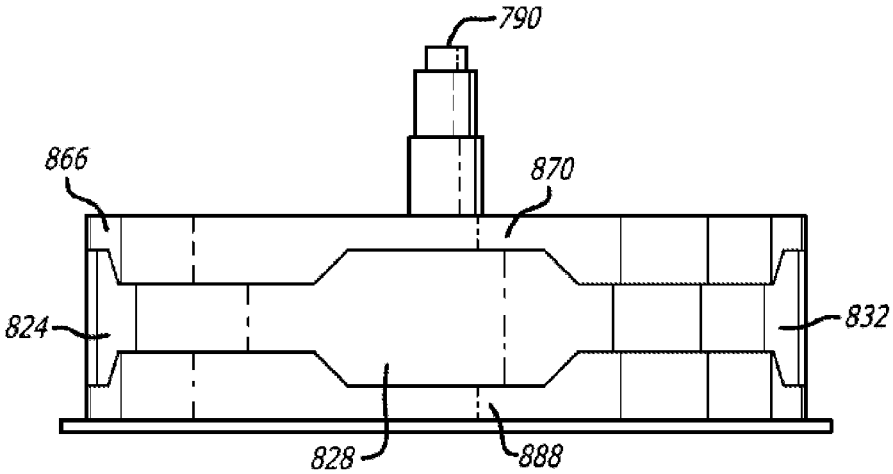
FIG. 20 is a view similar to FIG. 19 with the top tray in a yet still further rotated position and thereby in a second indexed position, and can be approximately ninety degrees relative to the indexed position of FIG. 16.

FIGS. 17-19 show the movement of the upper tray 730 from a first indexed position, as depicted in FIG. 16, to a second indexed position, as depicted in FIG. 20. As the upper tray 730 is rotated relative to the middle and lower trays 720, 710 as indicated by arrow 900, the slanted ends of each of the female areas of the upper tray slide up the adjacent slanted ends of the upper portions of the male members, as illustrated by arrow 910. Further rotation of the upper tray 730 causes the plateaus of the upper tray to slide along respective plateaus of upper portions of the male members, as shown in FIG. 18 by arrow 914. FIG. 19 then shows, as by arrow 918, the opposite slanted ends of the female areas of the upper tray sliding down along adjacent slanted ends of the upper portions of the male members. Continued rotation causes the upper tray 730 to fit down into the middle tray 720 to the second indexed position, as shown in FIG. 20. To move the upper tray 730 from the second indexed position to a third indexed position, it is rotated through another angular rotation, with a resulting similar up and down movement by the camming mechanisms, and so forth. The upper tray 730 can be rotated in the opposite rotational direction, if desired, to reach another indexed position.

Instead of rotating the upper tray 730 relative to the middle and lower trays 720, 710, the middle and lower trays can be rotated in the opposite direction relative to the upper tray. The middle and upper trays can similarly be rotated relative to the lower tray, or vice versa.

When the trays are in an indexed position, the trays can be in their lower positions, such as illustrated in FIGS. 16 and 20. This protects the Spices in the receptacles not exposed by the cutout(s). The indexed positions also provide a positive rotational relationship so that the desired receptacle(s) is fully aligned and exposed and not only partially exposed. The user thereby does not have to rotate one or more trays back and forth to get a proper positioning. The slants and plateaus also provide easy rotation surfaces of the trays. Further, the circumferential mating of the trays when in the indexed positions provides vertical and horizontal support of each tray on the tray below.

Another camming mechanism, a peg-in-groove mechanism, is depicted in FIGS. 21-26. Each of the rotatable trays 940, 950 of this camming mechanism can include pegs or similar members 954, 958 extending horizontally out from a circumference of the tray, as shown in FIGS. 23-26. The sidewall 960 of the cover 966 includes a serpentine, sinusoidal, ramp-plateau-ramp or similar groove 970, 974 for respective trays as shown in FIGS. 21-22. The sidewall 960 can be attached to the base 980. The pegs 954, 958 of each tray 940, 950 are positioned in the corresponding groove 970, 974 for that tray. Then when the tray is rotated relative to the cover 960, the tray is caused to travel up and down in a manner dictated by the respective groove from one indexed position to the next. The up and down motion can be understood from the dotted lines in FIGS. 23-26. The grooves 970, 974 can have flared ends 984, 988 (FIG. 22) at opposite sides of the cutout 992 to guide the pegs 954, 958 into their respective grooves.

A further camming mechanism is where one of the center posts includes a horizontal pin and another includes a groove with a sinusoidal, serpentine, ramp-plateau-ramp or similar configuration. The pin then rides in the groove as one tray is rotated relative to another causing a similar lifting and lowering movement of the upper tray or the lower tray.

A still further camming mechanism of the disclosure includes vertical pins/pegs extending up/down from a surface of one tray proximate a circumference thereof and a corresponding vertical groove on a surface of an adjacent tray proximate a circumference thereof. The top or bottom surface of the groove forms a path similar to that of the grooves 970, 974 of FIG. 22. As the pins/pegs ride in the groove the upper tray moves up and down as it is rotated. The lower tray can also be caused to move up and down as it is rotated.

Another exemplary embodiment includes a series of members on a top surface of a lower tray near the outer edge, between adjacent receptacles, where each member includes a first ramp, a plateau and then a second ramp. The upper tray includes on a bottom surface thereof a plurality of spaced bumps or the like. Thus, when one of the trays is rotated relative to the other, the upper tray rides up the first ramp, along the plateau and then down the second ramp to advance to the next receptacle position.

According to exemplary embodiments, the station or apparatus allows trays to rotate independently, and support depressing drinkware into the wetting reservoir and into receptacles filled with Spice. Additionally, the apparatus may be manufactured from any rigid material including, but not limited to, most rigid plastics, cardboard, ceramic, wood and/or metals, such as stainless steel or aluminum, or a combination of these materials.

A kit of the present disclosure can be provided to the user in one or more packages, containers or boxes, or unpackaged. It can include an apparatus as described herein either in a disassembled condition (see, e.g., FIGS. 1 and 13) or an assembled state (see, e.g., FIGS. 7, 16 and 23). The apparatus can be without a cover (see, e.g., FIG. 16) or can include a cover such as 966. The cover can include a wetting receptacle, such as shown in FIG. 6 at 340, or a tray can include a wetting receptacle, such as can be understood from FIG. 1 at 150. The apparatus can have one rotatable tray, two trays (such as shown in FIG. 10 at 120, 130) or more than two trays, such as shown in FIG. 13 at 710, 720, 730. The apparatus can have no base, a base separate from the bottom tray (see FIG. 1), or a base integral with the bottom tray (see FIG. 13). The apparatus can have tray "camming" mechanisms (see FIGS. 13 and 23) or no camming mechanisms. The receptacles can have closed flat bottom configurations, such as in FIG. 1, or partially open and "configured" bottom surfaces, such as illustrated in FIGS. 11 and 12 at 500, 502, 510, 520, 530.

In addition to the apparatus structure itself discussed above, the kit can include a wetting dish 154, a sponge 158 and a container 644 of wetting fluid 620, such as illustrated in FIGS. 1 and 10. It further can include dishes 174 or cartridges 560 for the Spices 600. The Spices 600 can be sealed into the dish or cartridge, as shown in FIG. 12. Alternatively, the Spices can be provided in separate bags. The selection of Spices provided in the kit can be those chosen by the purchaser or those chosen by the manufacturer. The kit can further include removable garnish dishes or trays, such as shown in FIGS. 1 and 5 at 310. The kit can further include one or more of the previously-mentioned handheld wetting agent swabs and/or sponge applicators. It can include a labeling system. The kit can even further include instruction materials and/or component/Spice reorder forms. Even still further, the kit can include any number of beverage garnishments such as picks, straws, napkins, packaged or canned fruit pieces, spice sticks and so forth.

The device or apparatus therefore can be a complete beverage condiment apparatus, allowing a user to moisten the rim of drinkware, select and apply a desired Spice to the rim of drinkware and also store and make easily and quickly accessible traditional beverage condiments or garnish from the same device or apparatus. Beverage preparation is thereby more efficient, convenient and ergonomic and makes better use of bar or countertop space.

Although the present inventions have been described in terms of the preferred embodiments above, numerous modifications and/or additions to the above-described preferred embodiments would be readily apparent to one skilled in the art. For example, the receptacles can extend up from top surfaces of the trays instead of extending down below. As another example, the inventions can include subassemblies or sub-methods. However, it is intended that the scope of the present inventions extend to all such modifications and/or additions and that the scope of the present inventions is limited solely by the claims set forth herein.

What is claimed is:

1. A drinkware rimming apparatus, comprising:

a first tray having a first spice receptacle and a second receptacle;

a second tray positioned above the first tray;

the second tray having a third spice receptacle, a fourth spice receptacle and an access cutout; and the first tray and/or the second tray being rotatable relative to the other and about a vertical axis passing through the first and second trays so that the access cutout is in an operative position over the first spice receptacle, the second receptacle or another desired portion of the first tray, wherein both of the first and second trays have respective ramping structures that operatively interact with each other during the rotational movement to cause the second tray to lift and drop between two indexed positions by rotational movement of at least one of the first and second trays relative to the other.

2. The apparatus of claim 1 wherein the second receptacle comprises a wetting receptacle.

3. The apparatus of claim 1 wherein the second receptacle comprises a second spice receptacle.

4. The apparatus of claim 1 further comprising a spice liner having a raised central portion and positionable in one of the spice receptacles.

5. The apparatus of claim 1 wherein the axis passes through a central location of the first tray and a central location of the second tray and where the axis (post) of the first tray extends through the center (opening) of the second tray.

6. The apparatus of claim 1 further comprising a cover positioned over the first and second trays, the cover including a downwardly extending sidewall enclosing the first and second trays.

7. The apparatus of claim 6 wherein the cover has a plurality of beverage garnish compartments on a top surface thereof.

8. The apparatus of claim 7 wherein the beverage garnish compartments include one or more trays that are removable and separable from the cover.

9. The apparatus of claim 6 further comprising a support base, and wherein the sidewall is attached to the support base.

10. The apparatus of claim 6 wherein the cover has an access cutout with which the access cutout of the second tray is vertically alignable by rotating the second tray relative to the cover.

11. The apparatus of claim 6 wherein the cover includes a wetting receptacle on a top surface thereof, and a wetting dish positionable in the wetting receptacle.

12. The apparatus of claim 6 wherein the first tray includes a first post disposed along the axis, the second tray includes a second post disposed along the axis in which at least a portion of the first post is positioned, and the cover includes a top surface opening through which the first and second posts extend.

13. The apparatus of claim 1 wherein the second tray rests on and is supported by the first tray, wherein the first tray includes a first post, and the second tray includes a second post in which at least a portion of the first post is disposed.

14. A drinkware rimming apparatus, comprising:

a first tray rotatable relative to a support surface of the apparatus and about a vertical axis;

the first tray having (a) a first spice receptacle and (b) a second spice receptacle or a wetting receptacle;

a second tray having a third spice receptacle and a fourth spice receptacle;

the second tray being positioned above the first tray, supported by the first tray and rotatable about the vertical axis;

the second tray having an access cutout providing downward access to a desired portion of the first tray; and a mechanism including a plurality of first members on one of the first and second trays and a plurality of corresponding second members on the other one of the first and second trays that engage to lift the second tray relative to the first tray at one indexed position and lower the second tray to another indexed position when at least one of the first and second trays is rotated relative to the other.

15. The apparatus of claim 14 wherein the mechanism includes a pin-and-groove assembly.

16. The apparatus of claim 15 further comprising:

a cover having a sidewall that descends downwardly over the second and first trays, and wherein the mechanism comprises a pin-and-groove assembly that includes a pin attached to one of the first and second trays and a groove in the sidewall in which the pin rides as the first and second trays are rotated relative to the cover.

17. A drinkware rimming apparatus, comprising:

a base;

a tray supported by the base;

the tray having a first spice receptacle and a second receptacle; and a cover positioned over the tray, attached to the base and having an access cutout, the cover including a downwardly extending sidewall enclosing the tray and having a plurality of beverage garnish compartments on a top surface thereof; and the tray being rotatable relative to the base and the cover about a vertical axis passing through a central area of the tray.

18. The apparatus of claim 17 wherein the second receptacle is a wetting receptacle.

19. The apparatus of claim 17 wherein the second receptacle is a second spice receptacle.

20. The apparatus of claim 19 wherein the cover includes a plurality of beverage garnish compartments on a top surface thereof.

21. The apparatus of claim 17 wherein the tray defines a first tray, and further comprising: a second tray having a third spice receptacle, the second tray being positioned above the first tray and being rotatable about the vertical axis and generally independently of the first tray, and the second tray having an access cutout providing downward access to a desired portion of the first tray.

22. The apparatus of claim 21 wherein the base includes a pivot post, the first tray includes a post that is pivotal on the pivot post, the second tray includes a sleeve by which the pivot post centers the tray, and the cover includes an opening up through which the sleeve extends.

23. The apparatus of claim 17 wherein one of the tray or the cover includes a wetting receptacle and further comprising a wetting dish positionable in the wetting receptacle.

24. The apparatus of claim 17 further comprising a spice liner having a raised central portion and positionable in the first spice receptacle.

25. A drinkware rimming apparatus, comprising:

a first tray rotatable relative to a support surface of the apparatus and about a vertical axis;

the first tray having (a) a first spice receptacle and (b) a second spice receptacle or a wetting receptacle;

a second tray having a third spice receptacle and a fourth spice receptacle;

the second tray being positioned above the first tray and rotatable about the vertical axis; and a assembly having first and second mating portions, the first portion disposed on the first tray and the second portion disposed on the second tray that, when at least one of the first and second trays is rotated relative to the other, lifts the second tray relative to the first tray at one indexed position and then lowers the second tray relative to the first tray to another indexed position.

26. The apparatus of claim 25 wherein the cam assembly, when at least one of the first and second trays is rotated relative to the other, lowers the first tray relative to the second tray at one indexed position and then raises the first tray relative to the second tray to another indexed position.

27. The apparatus of claim 9, further comprising:

a mechanism including a plurality of first members on one of the base and sidewall of the cover and a plurality of corresponding second members on the other one of the base and sidewall of the cover that engage to fasten the base to the sidewall of the cover.

* * * * *